US010022741B2

(12) United States Patent
Fuller et al.

(10) Patent No.: US 10,022,741 B2
(45) Date of Patent: Jul. 17, 2018

(54) SELECTIVELY ACTUATED FLUID DISPENSER

(71) Applicant: NSE Products, Inc., Provo, UT (US)

(72) Inventors: Kevin Gregory Fuller, Highland, UT (US); Oliver Brian Godbold, Hertfordshire (GB); Rebecca Ann Wilkins, Essex (GB); Henry Charles Innes, Cambridge (GB); Carl Gordon Hewett, Cambridgeshire (GB); Iain Ansell, Suffolk (GB)

(73) Assignee: NSE Products, Inc., Provo, UT (US)

( * ) Notice: Subject to any disclaimer, the term of this patent is extended or adjusted under 35 U.S.C. 154(b) by 0 days.

(21) Appl. No.: 14/832,085

(22) Filed: Aug. 21, 2015

(65) Prior Publication Data

US 2016/0052007 A1 Feb. 25, 2016

Related U.S. Application Data

(60) Provisional application No. 62/040,715, filed on Aug. 22, 2014.

(51) Int. Cl.
*B67D 7/78* (2010.01)
*B05B 11/00* (2006.01)
(Continued)

(52) U.S. Cl.
CPC ..... *B05B 11/3084* (2013.01); *A45D 34/00* (2013.01); *A45D 40/00* (2013.01);
(Continued)

(58) Field of Classification Search
CPC ..... B05B 11/3084; B05B 11/0054; B05B 11/0078; B05B 12/122; B05B 12/1409; B05B 12/1454; A45D 34/00; A45D 40/00; A45D 2034/005; A45D 2200/058; A47K 5/1202; A47K 5/1217; B01F 5/061; B01F 15/0087; B01F 15/0243
(Continued)

(56) References Cited

U.S. PATENT DOCUMENTS 3,236,418 A 2/1966 Dalle et al.
3,760,986 A * 9/1973 Castner ..... B05B 11/0056 222/137
(Continued)

FOREIGN PATENT DOCUMENTS

CN 1217278 A 5/1999
CN 1234779 A 11/1999
(Continued)

OTHER PUBLICATIONS

"Point" Merriam-Webster.com. Merriam-Webster, Nov. 2017.*
(Continued)

*Primary Examiner* — Benjamin R Shaw
(74) *Attorney, Agent, or Firm* — Dorsey & Whitney LLP

(57) ABSTRACT

An apparatus includes a selectively actuated fluid system having a plurality of selected fluid reservoirs, for example replaceable cartridge-type fluid reservoirs. A first subset of the reservoirs can be selectively actuated to dispense an individual fluid from the selected reservoir. A second subset of the reservoirs can be simultaneously actuated to dispense two or more fluids in mixed form.

16 Claims, 29 Drawing Sheets

(51) Int. Cl.

| | |
|---|---|
| ***A45D 34/00*** | (2006.01) |
| ***A45D 40/00*** | (2006.01) |
| ***A47K 5/12*** | (2006.01) |
| ***B01F 15/02*** | (2006.01) |
| ***B05B 12/12*** | (2006.01) |
| ***B05B 12/14*** | (2006.01) |
| ***B01F 5/06*** | (2006.01) |
| ***B01F 15/00*** | (2006.01) |

(52) U.S. Cl.
CPC ..... *A47K 5/1202* (2013.01); *A47K 5/1217* (2013.01); *B01F 5/061* (2013.01); *B01F 15/0087* (2013.01); *B01F 15/0243* (2013.01); *B05B 11/0054* (2013.01); *B05B 11/0078* (2013.01); *B05B 12/122* (2013.01); *B05B 12/1409* (2013.01); *B05B 12/1454* (2013.01); *A45D 2034/005* (2013.01); *A45D 2200/058* (2013.01)

(58) Field of Classification Search
USPC ..... 222/145.5
See application file for complete search history.

(56) References Cited

U.S. PATENT DOCUMENTS 3,876,112 A 4/1975 Kramer
4,139,114 A 2/1979 Long et al.
4,335,837 A 6/1982 Bono
4,549,674 A 10/1985 Alticosalian
4,826,048 A 5/1989 Skorka et al.
5,169,029 A * 12/1992 Behar ..... B05B 11/3084 128/200.23
5,174,476 A 12/1992 Steiner et al.
5,186,360 A 2/1993 Mease et al.
5,351,862 A 10/1994 Weag
5,358,147 A * 10/1994 Adams ..... B65D 83/386 222/183
5,568,883 A 10/1996 Cataneo et al.
5,645,193 A 7/1997 Gentile et al.
5,848,732 A * 12/1998 Brugger ..... B05B 11/3083 222/137
5,865,345 A 2/1999 Cistone et al.
5,947,335 A 9/1999 Milio et al.
6,006,948 A 12/1999 Auer
6,082,580 A 7/2000 Mueller et al.
6,082,588 A * 7/2000 Markey ..... B05B 11/3084 222/135
6,230,935 B1 5/2001 Mack et al.
6,299,023 B1 10/2001 Arnone
6,454,135 B1 * 9/2002 Brozell ..... B05B 11/3011 222/135
6,499,900 B1 12/2002 Brozell
6,557,729 B2 5/2003 Gauthier
6,640,999 B2 11/2003 Peterson
6,648,641 B1 11/2003 Viltro et al.
6,715,641 B2 4/2004 Torimitsu et al.
6,715,642 B2 4/2004 Engel et al.
6,722,532 B2 4/2004 Lasserre et al.
7,063,235 B2 6/2006 Auer
7,124,914 B2 10/2006 Foster et al.
7,222,752 B2 * 5/2007 Ponton ..... B05B 11/3083 222/134
7,247,140 B2 7/2007 Ophardt
7,461,987 B2 12/2008 Liechty et al.
7,510,101 B2 3/2009 Foster et al.
7,651,035 B2 1/2010 van der Heijden
7,654,415 B2 2/2010 van der Heijden
7,793,799 B2 9/2010 Reggiani
7,795,584 B2 9/2010 Mok et al.
7,854,350 B2 12/2010 Lasserre et al.
8,021,064 B2 9/2011 Gueret
8,245,877 B2 8/2012 Ophardt
8,292,126 B2 10/2012 Pittaway et al.
8,294,585 B2 10/2012 Barnhill
8,344,393 B2 1/2013 Drammeh
8,385,270 B2 2/2013 Pedlar et al.
8,395,396 B2 3/2013 Hagleitner
8,418,887 B2 4/2013 Milian et al.
2001/0025859 A1 10/2001 Dumont
2003/0006247 A1 1/2003 Olivier et al.
2003/0194678 A1 * 10/2003 Viltro ..... A61K 8/02 433/80
2004/0016773 A1 1/2004 Wagner
2004/0226962 A1 11/2004 Mazursky et al.
2006/0163282 A1 7/2006 Suzuki
2007/0289997 A1 12/2007 Lewis et al.
2007/0289999 A1 * 12/2007 Rossignol ..... B05B 11/0078 222/137
2008/0135578 A1 6/2008 Ophardt
2008/0149126 A1 6/2008 Abergel
2009/0140004 A1 * 6/2009 Scorgie ..... A47K 5/1217 222/52
2009/0179047 A1 7/2009 Foster et al.
2009/0184137 A1 7/2009 O'Brien
2009/0216183 A1 * 8/2009 Minotti ..... A61M 15/08 604/82
2009/0272759 A1 * 11/2009 Bambrick ..... B65D 81/325 222/1
2010/0044394 A1 2/2010 Milian et al.
2010/0091478 A1 * 4/2010 Miller ..... B05B 11/0078 362/34
2010/0108779 A1 * 5/2010 Filsouf ..... B05B 11/0054 239/61
2011/0075510 A1 * 3/2011 Sacchet ..... B01F 13/1058 366/152.2
2011/0101021 A1 5/2011 Greer et al.
2011/0139821 A1 * 6/2011 Greter ..... A61B 17/00491 222/145.5
2011/0303695 A1 12/2011 Fern
2012/0031925 A1 * 2/2012 Greenberg ..... B05B 11/3059 222/135
2012/0279990 A1 11/2012 Werner et al.
2012/0298694 A1 * 11/2012 Holzmann ..... B05B 11/3056 222/135
2013/0299514 A1 * 11/2013 Holzmann ..... B05B 11/3084 222/134
2014/0144927 A1 * 5/2014 Hourmand ..... B67D 1/1405 222/94
2014/0197196 A1 * 7/2014 Tederous ..... A47K 5/1208 222/52
2014/0319238 A1 * 10/2014 Su ..... A45D 34/00 239/70
2015/0375245 A1 * 12/2015 Burrowes ..... B05B 11/3001 222/136
2016/0058156 A1 * 3/2016 Chiasson ..... A45D 40/24 132/200
2016/0199864 A1 * 7/2016 Quennessen ..... B05B 11/3083 222/135
2016/0286932 A1 * 10/2016 Lee ..... A45D 34/00
2016/0318055 A1 * 11/2016 Scott ..... B05B 11/3084

FOREIGN PATENT DOCUMENTS

CN 1349919 A 10/2001
CN 1474672 A 11/2001
CN 1532400 A 9/2004
CN 1754788 A 4/2006
CN 1803062 A 7/2006
CN 200988015 Y 12/2007
GB 2307674 A 6/1997
JP 2009132438 A 6/2009
WO WO2006006058 A2 1/2006
WO WO2010003091 A1 1/2010

OTHER PUBLICATIONS

VariBlend Dual Dispensing Systems, "How it Works," from <http://www.variblend.com/how-it-works/>.
The International Search Report and Written Opinion dated Nov. 2,

(56) References Cited

OTHER PUBLICATIONS 2015 in connection with International Application No. PCT/US2015/046275.

* cited by examiner

YOU'LL NOW HAVE ALL THE PRODUCTS YOU NEED FOR YOUR TRIP.

SELECTIVELY ACTUATED FLUID DISPENSER

CROSS-REFERENCE TO RELATED APPLICATION

This application claims priority to U.S. Provisional Application No. 62/040,715, SELECTIVELY ACTUATED FLUID DISPENSER, filed Aug. 22, 2014, which is incorporated by reference herein, in the entirety and for all purposes.

BACKGROUND

This disclosure relates generally to fluid systems, and particularly to actuated systems for dispensing fluids from reservoirs. More specifically, the disclosure relates to selectively actuated systems with a plurality of fluid reservoirs in the form of cartridges. Particular applications include, but are not limited to, selectively actuated skin treatment dispensing systems for personalized skin care products.

Fluid dispensing systems are utilized to deliver a variety of different materials such as soaps, cleaners, perfumes, antibiotic agents, lotions, adhesives and other household and personal hygiene products. Fluid dispensing systems can also be used to provide skin care products, including lotions, moisturizes, and creams.

Generally, fluid dispensers are divided into manual or mechanically actuated designs, and automated (e.g. electrically actuated) systems. Depending on application, manually-operated dispenser systems typically generate a single fluid stream from an individual fluid reservoir, but mixed-component designs are also known. Automated dispenser systems may include additional features, for example automated timing and flow control, and both manual and automated dispensers may incorporate refillable or disposable (single-use) fluid reservoirs.

Nonetheless, advanced skin care systems and other precision fluid delivery applications may require new features that are not found in the prior art. In particular, the full range of new and personalized skin care products is not available in standard single-use dispensers, and existing refillable systems face a range of engineering challenges. Moreover, to the extent a skin care regimen uses multiple products, requires mixing of custom-selected products or is based on use of multiple products to be applied at different times in a day, the prior art lacks a solution that supports such a more complex regimen and enables a user to follow it. Other challenges include the need for improved product delivery, reduced waste, and ease of use, coupled with an ongoing demand for increased reliability and service life.

Product contamination is also an important consideration, in both disposable and refillable designs. As a result, there is a continuing need for advanced fluid dispensing systems, which can provide an improved user experience without suffering the known engineering deficiencies of the prior art. In particular, there is a need for more advanced, selectively actuated fluid dispensing systems, which can be utilized with a range of different fluid reservoirs and adapted to precision fluid dispensing applications in a hygienic environment, including advanced, personalized skin care applications.

SUMMARY

This disclosure relates to fluid systems, and particularly to selectively actuated fluid systems with a plurality of fluid reservoirs, for example replaceable cartridge-type fluid reservoirs. Depending upon application, a first subset of the reservoirs can be selectively actuated to dispense an individual fluid from the selected reservoir in the first subset. A second subset of the reservoirs can be simultaneously actuated to dispense two or more fluids in mixed form. Actuation of the reservoirs in the first and second subsets can be independently controlled, according to user preference, or the subsets can be actuated in a programmed series.

DETAILED DESCRIPTION

Overview

Figure 1:
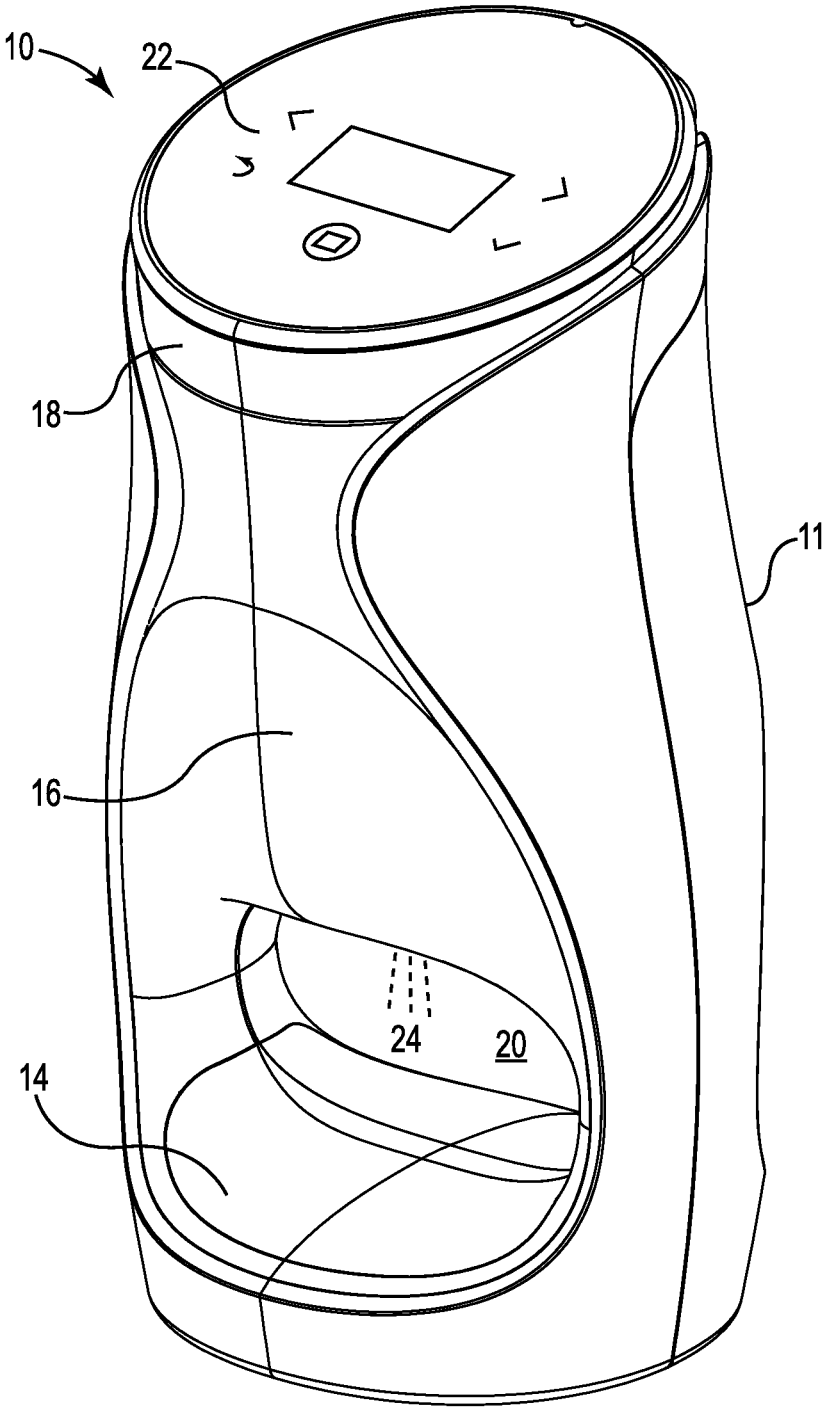
FIG. 1 is a perspective view of a fluid dispensing system.

FIG. 1 is a perspective view of fluid dispensing system 10, in a standalone or portable dispenser embodiment. As shown in FIG. 1, system (or apparatus) 10 includes housing 11 with a lower portion or base assembly 14, a middle portion or pump section 16, and an upper portion or lid assembly 18.

In this particular embodiment, a dispensing opening or archway 20 is located between base section 14 and pump section 16, extending through housing 11 from the front to the back of dispenser system 10, and lid assembly 18 includes user controller interface 22. User controller interface 22 can be utilized or configured for selective actuation of system 10, in order to dispense one or more selected fluids 24 when the user's hand is inserted into opening 20.

Figure 2B:
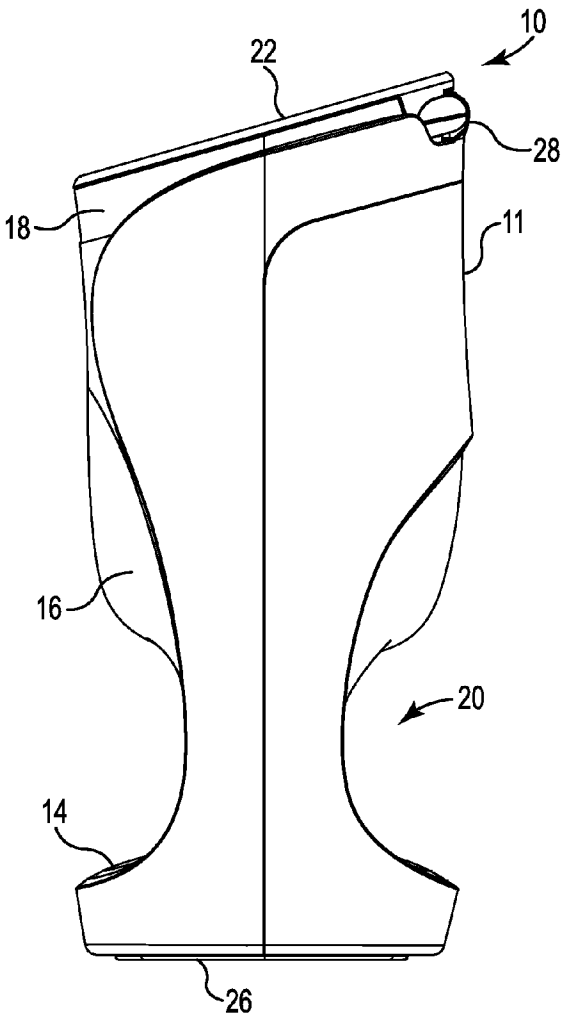
FIG. 2B is a side view of the fluid dispensing system.
Figure 2A:
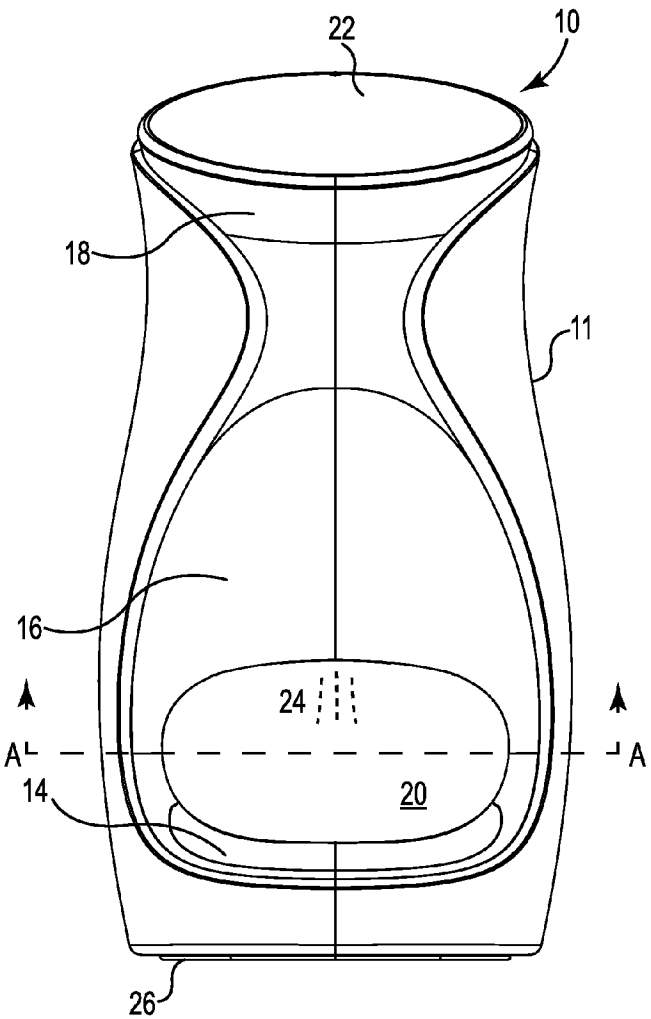
FIG. 2A is a front view of the fluid dispensing system.

FIG. 2A is a front view of fluid dispensing system 10. As shown in FIG. 2A, base section 14 of housing 11 may include a number of feet or other stabilizing features 26.

FIG. 2B is a side view of fluid dispensing system 10. As shown in FIG. 2B, lid assembly (or lid) 18 may be coupled to housing 11 via a hinged or removable attachment 28, so that lid 18 is rotatable or positionable between open and closed states or configurations. Thus, the user can open lid 18 to insert, remove and/or replace selected fluid reservoirs or cartridges within housing 11, and close lid 18 in order to operate system 10 and dispense selected fluids from one or more of the reservoirs.

Figure 3:
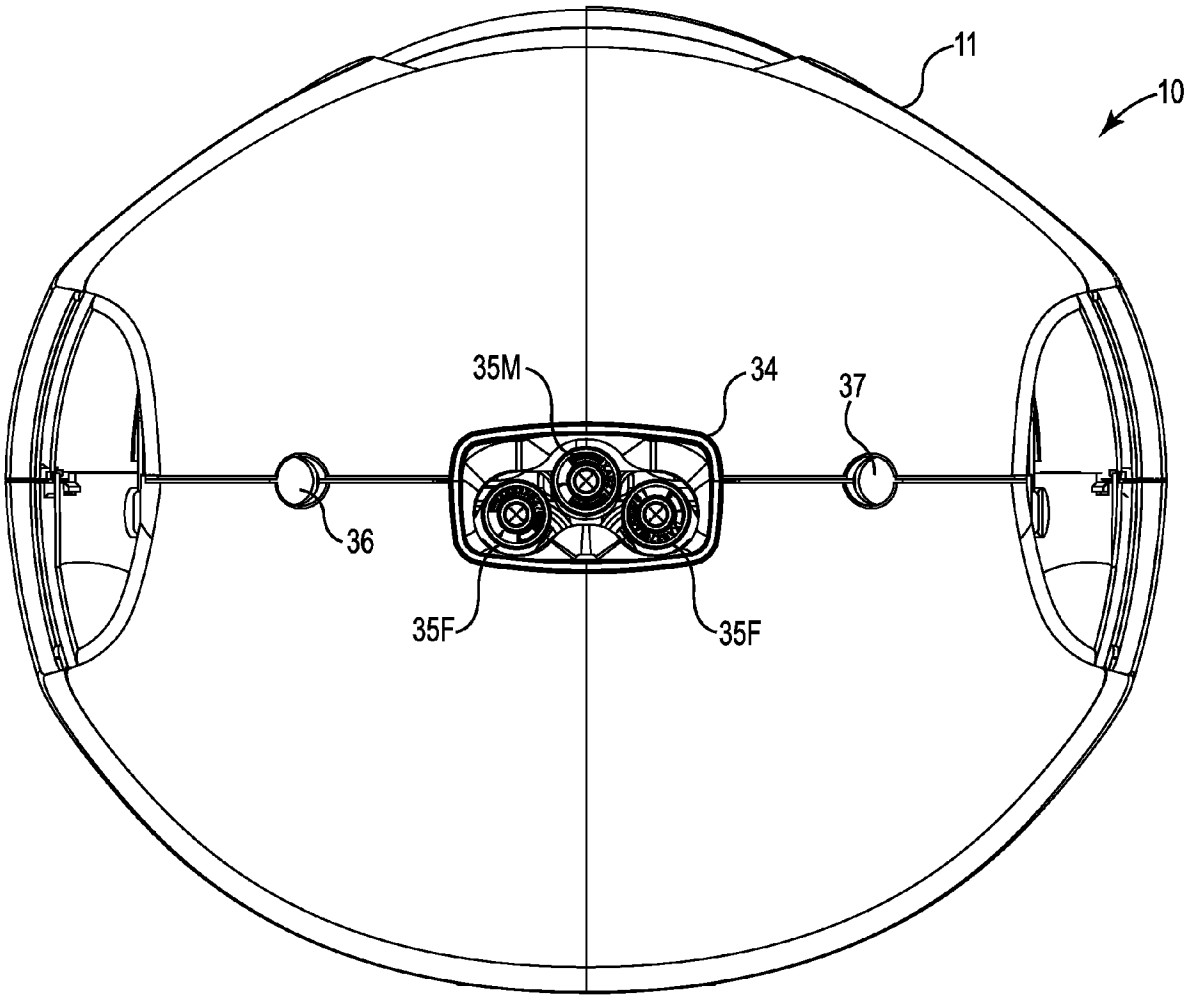
FIG. 3 is a cross-sectional view of the dispensing system, taken along lines A-A of FIG. 2A and showing representative fluid dispenser outlets.

FIG. 3 is a bottom cross-sectional view of fluid dispensing system 10, taken along line A-A of FIG. 2A (with the feet and base portion removed), showing a representative fluid dispenser or nozzle shroud 34 located in a dispenser station or opening 20. In this particular embodiment, three individual fluid nozzles or apertures 35F and 35M are included, for example with left and right dispenser nozzles 35F configured to selectively dispense individual fluids from a first subset of fluid reservoirs within housing 11, and middle dispenser nozzle 35M configured to selectively dispense a mixture of fluids from a second subset of fluid reservoirs within housing 11. Individual nozzles 35F and 35M may be provided in self-closing form, and included with the replaceable cartridge reservoirs for improved sanitary operation as described below.

A fluid dispenser (or system) 10 may include a touchless activation system in order to dispense fluid from one or more dispenser nozzles 35F and 35M in a sanitary fashion, without requiring the user to contact a button, switch, or other conventional mechanical component of dispensing system 10. For example, an optical or infrared (IR) emitter 36 and sensor 37 may be provided to detect the user's hand when inserted into dispenser opening 20, and configured to actuate a controller 500 (see FIG. 26) of system 10 in order to dispense one or more fluids 24. Other suitable sensor technologies include, but are not limited to, capacitive sensors, imaging sensors, motion sensors, and other active or passively-triggered proximity sensor technologies. A touch sensor, touch screen, mechanical button actuator, or similar actuator component connected to controller 500 can also be provided, located either in dispenser opening 20 or elsewhere on housing 11, or incorporated into the user interface, as described below.

Figure 4:
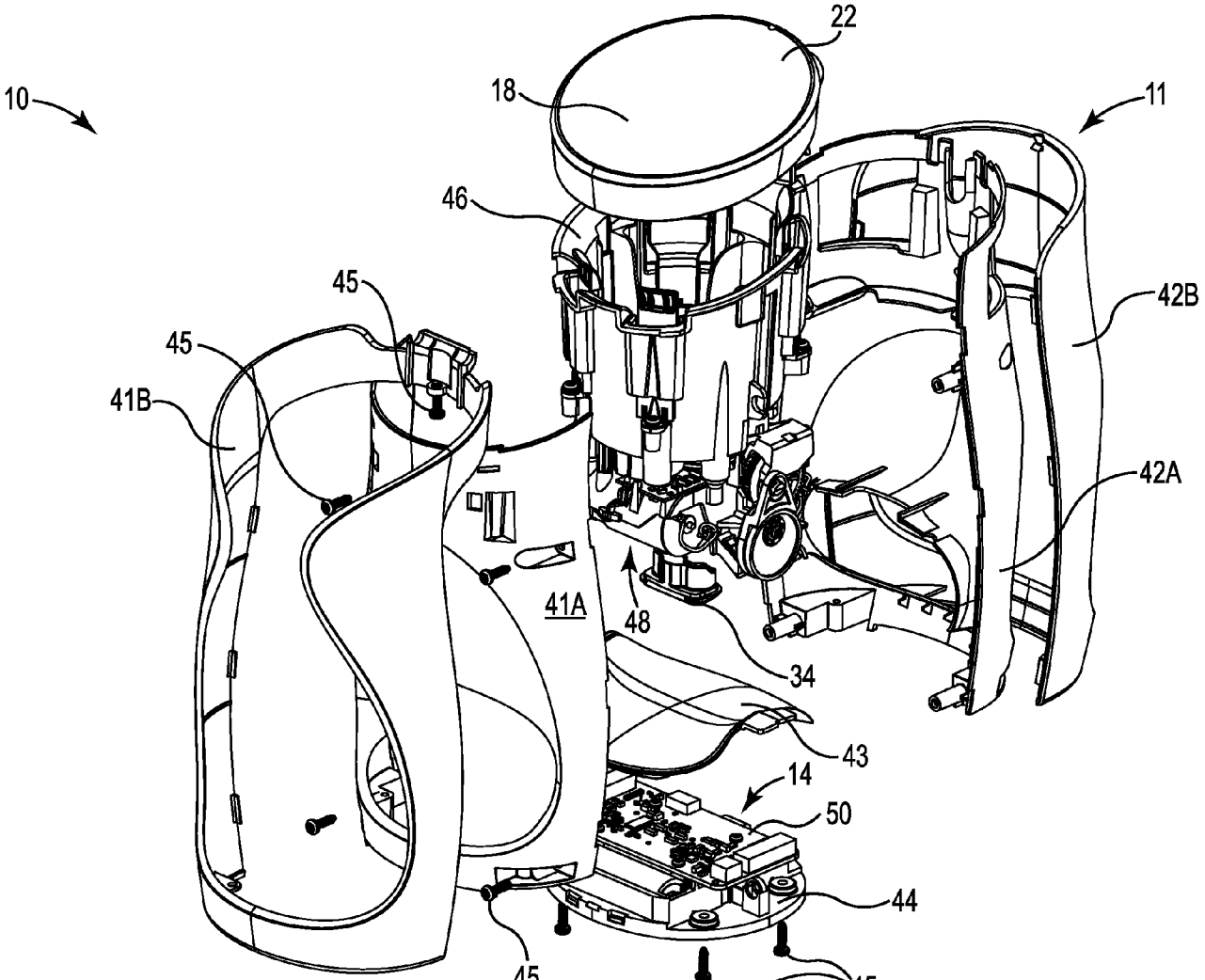
FIG. 4 is an exploded view of the fluid dispensing system.

FIG. 4 is an exploded view of fluid dispensing system 10. As shown in FIG. 4, system 10 includes a multi-part housing or case 11, for example with inner and outer front and back sections 41A/B and 42A/B, lower arch or base cover 43, and bottom cover 44. A user controller interface 22 is provided in lid assembly 18, which can be coupled to housing 11 via a hinged attachment or other coupling arrangement configured to open and close lid 18, in order to provide access to the interior of dispenser system 10. The interior includes a well assembly 46, where fluid cartridges are stored for pumped actuation Additional internal components of dispenser system 10 include well assembly 46 with motor or pump drive assembly 48 configured to dispense fluids from selected reservoirs, and a battery pack, voltage regulator, or other power module 50. In this particular example, power module 50 includes one or more (e.g., single-use or rechargeable) batteries configured to provide electrical power to controller 500 and drive assembly 48, in order to selectively dispense fluid from one or more dispensing apertures in nozzle shroud 34, as described above.

Suitable materials for housing 11 and lid 18 include, but are not limited to, plastics and other durable polymers, composite materials, metals, and combinations thereof. The various components of housing 11 can be coupled together via screws, pins or other mechanical fasteners 45, as shown in FIG. 4, using an adhesive, or via chemical or heat welding. Alternatively, housing 11 can be provided in substantially unitary form.

Figure 5:
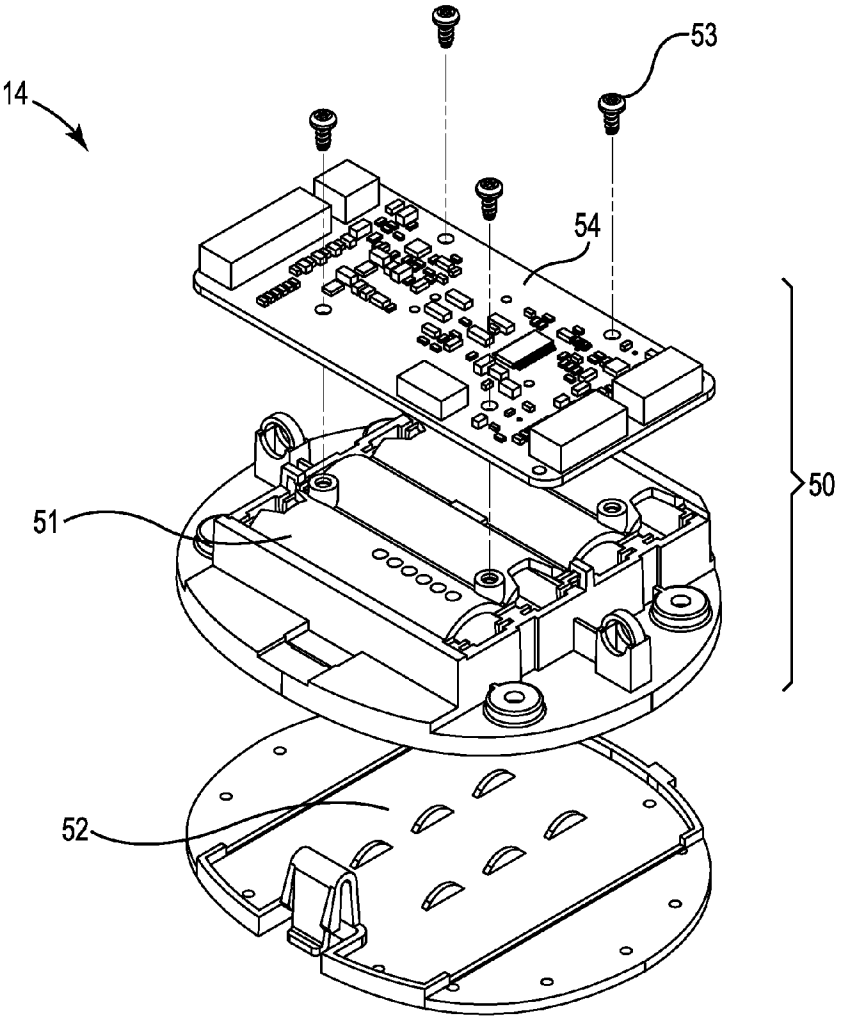
FIG. 5 is an exploded view of a bottom assembly for the fluid dispensing system, with representative power supply components

FIG. 5 is an exploded view of base section or bottom assembly 14 for fluid dispensing system 10. As shown in FIG. 5, base assembly 14 includes power supply module 50 with representative power supply components including, but not limited to, a battery box or other power system 51, access cover or lid 52, and mechanical fasteners or other coupling elements 53 for electronic circuit board components 54.

In battery-powered embodiments, battery box 51 typically includes one or more individual batteries, for example four AA type batteries, or another standard battery configuration. Circuit board components 54 may also include a combination of voltage and current supplies or regulators configured to provide power to dispenser system 10, for example from an internal (e.g., rechargeable) battery pack or other DC power source 51. A line outlet (e.g. AC) connector may also be provided, for example to provided regulated power to recharge the internal batteries, or to provide regulated power for operation of fluid dispensing system 10.

Figure 6B:
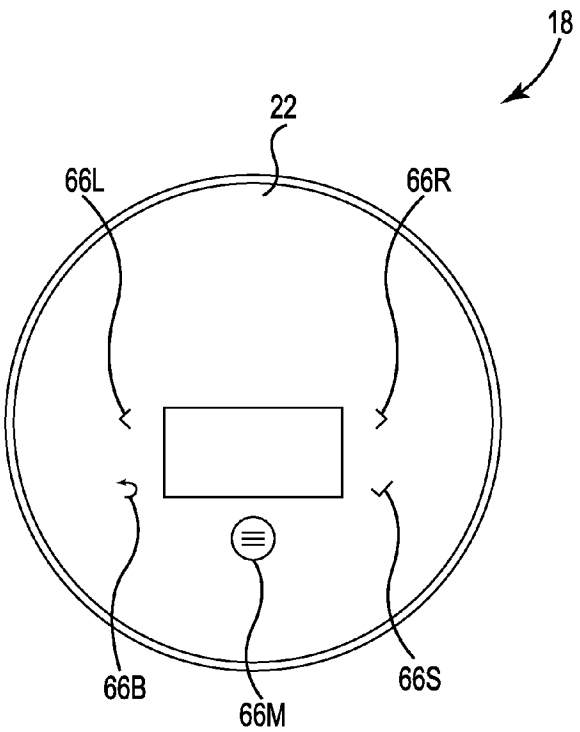
FIG. 6B is a schematic view of a representative user interface or control panel provided on the top assembly.
Figure 6A:
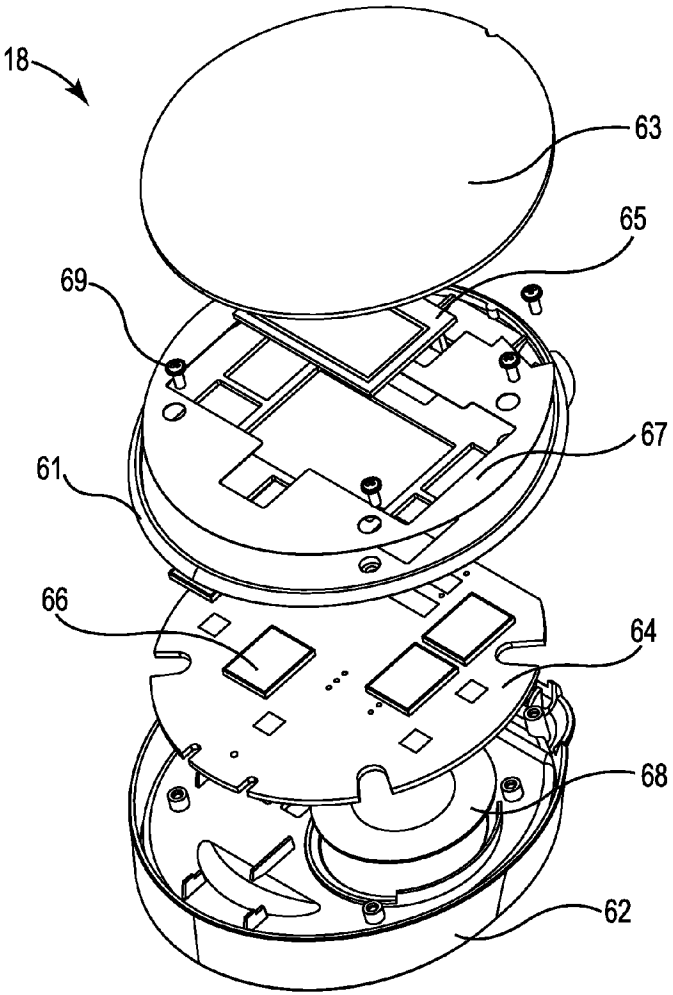
FIG. 6A is an exploded view of a top assembly for the fluid dispensing system.

FIG. 6A is an exploded view of lid assembly 18 for fluid dispensing system 10. As shown in FIG. 6A, lid assembly 18 includes lid base 61, lid top 62, and user controller interface 22 on display cover 63. Selected electronic circuit components 64 include a processor (or microprocessor), memory, firmware, and other electronic components comprising a controller 500 (see FIG. 26) configured to aid user operation and performing control logic of fluid dispensing system 10. Alternatively, discrete electronic components 64 may provide the desired control logic for controller 500 and user interface functionalities.

Additional user interface and controller components may include an LED display or similar graphical user interface or display 65, capacitive buttons or other user input sensors 66, and a speaker, vibrator, piezoelectric element, or similar output component 68 configured to generate sound and/or haptic feedback. The various user interface, controller, and structural components of lid assembly 18 can be coupled together via variety of different techniques, for example using a combination of adhesive components 67 and mechanical fasteners 69.

FIG. 6B is schematic view of a representative user controller interface 22, for example as provided on the top or display surface of lid assembly 18, as shown in FIG. 6A. In this particular example, user controller interface 22 includes user display 65 and a variety of selector and display control buttons 66, for example left button 66L, right button 66R, back button 66B, menu button 66M and select/confirm button 66S.

In one particular example, left and right buttons 66L and 66R can be used to cycle through various screen or menu options defined by menu selection button 66M, for example in the left (backward) and right (forward) directions, respectively. Menu button 66M may provide additional menu options such as time and other dispenser settings, product or fluid delivery, and optional dispenser options, e.g., for vacations or other planned travel periods. Select/confirm button 66S is used to confirm the menu selections defined by buttons 66L, 66R, 66M and 66B.

In one embodiment, the user can "wake" (or power on) dispensing system (or device) 10 by placing a finger, hand or other object in the dispensing opening or archway, activating the IR, motion or proximity sensor. A confirmatory message such as "ready?" is then provided on display 65, and the user can touch a button on user interface/controller 22 (e.g., select button 66S) to enable fluid delivery, for example as accompanied by a second message such as "serum" or "fluid" in display 65. Alternatively, the user can enable fluid delivery by removing and replacing the hand, or otherwise changing position with respect to the motion or proximity sensor, so that no direct physical contact is required.

A third message can be provided on display 65 during fluid delivery, e.g. accompanied by a droplet or other appropriate graphical indicator. A fourth message such as "complete" can then be displayed to indicate that delivery is finished. Dispenser system 10 can also be configured to automatically power down at the end of the cycle, for example after a preselected period of time, or when one or more buttons 66 are pressed on user interface/controller 22, with or without a corresponding message on user display 65.

User controller interface 22 and display 65 can also be configured to indicate selected fluid delivery configurations, for example based on time of day or user selection. In one embodiment, for example, dispenser system 10 can be configured to selectively dispense a particular fluid from one of a first subset of individual, selectively actuated fluid reservoirs, for example from a day or night (or morning or evening) cartridge reservoir based on time of day. Alternatively, the individual cartridges may be alternately selected (that is, first one, then other, repeatedly). The individual fluids can also be dispensed from separate nozzles, either to discourage mixing, for improved sanitary conditions, or both.

User controller interface 22 can also be configured for dispenser system 10 to dispense a mixture of fluids prepared from a second subset of the reservoirs. For example, fluids from two, three or more cartridges can be mixed together within dispenser 10, and dispensed in a mixed stream from a single mixed fluid nozzle or aperture, as described above. Alternatively, different fluid streams can be simultaneously dispensed in separate nozzles, or sequentially dispensed from a single nozzle, and then mixed together by the user.

Selected dispensing sequences can also encompass both single-fluid dispensing from one or more selected fluid cartridges or reservoirs, and mixed fluid dispensing from two or more simultaneously actuated fluid cartridges or reservoirs. For example, a first single-mode (e.g., day or night treatment) step may be performed to dispense fluid from an individual selectively actuated fluid cartridge or reservoir, and a second mixed-mode (e.g., serum treatment) step may be performed to dispense a mixed fluid from a combination of two or more different simultaneously actuated fluid cartridges or reservoirs. The order and sequencing of the single-mode and mixed-mode dispensing steps is flexible and programmable in controller 500, and they may be performed in any order or combination without loss of generality—for example, based on user preference or selection, or based on pre-programmed dispensing instructions stored in software or firmware.

Well Assembly

Figure 7:
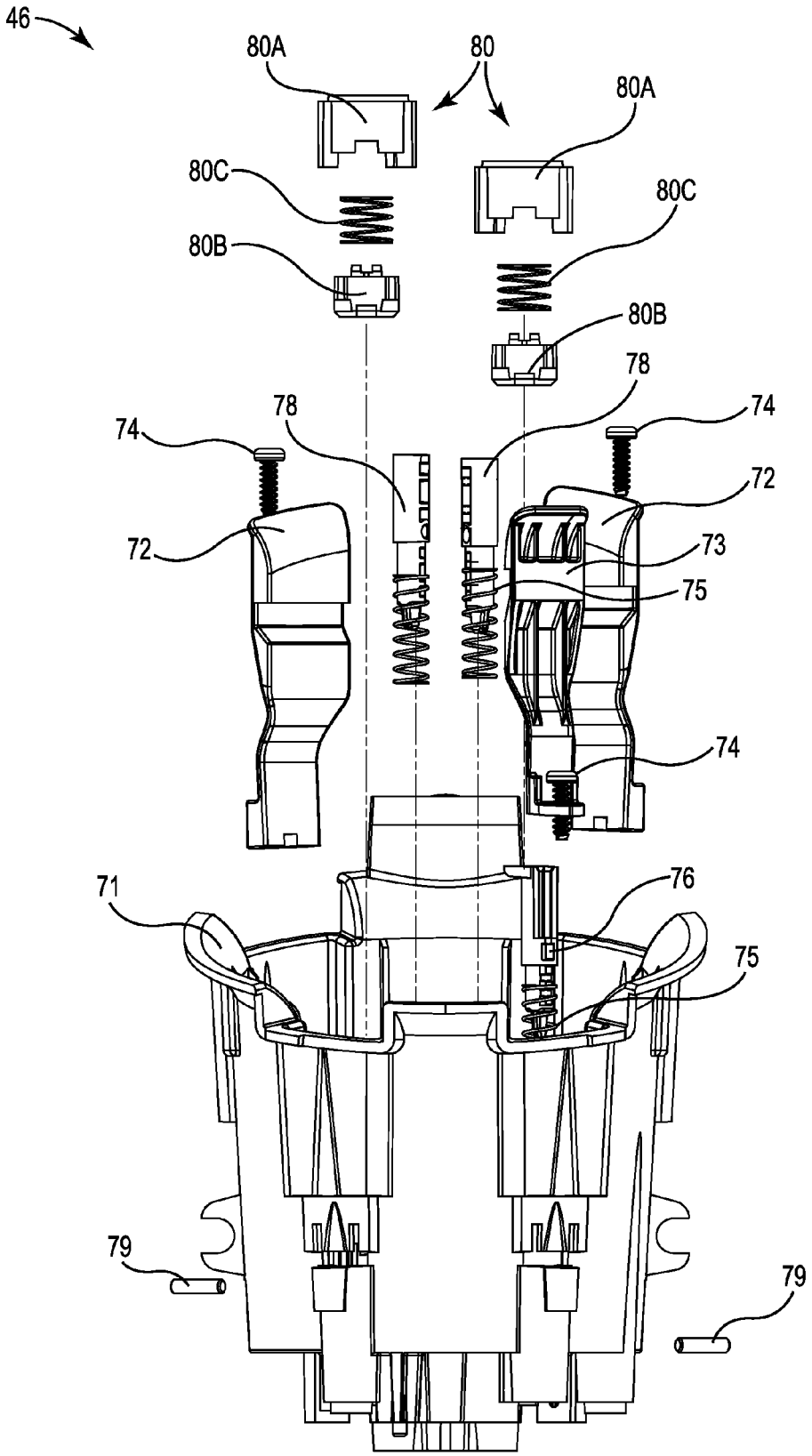
FIG. 7 is an exploded view of a well assembly for the fluid dispensing system.

FIG. 7 is an exploded view of well assembly 46 for fluid dispensing system 10. As shown in FIG. 7, well assembly includes well housing or frame 71, configured to hold a plurality of replaceable fluid reservoirs or cartridges. Suitable materials for well housing 71 include plastics and other durable polymer materials, composite materials, metals, and combinations thereof.

Well housing 71 may include a variety of features configured to enable insertion, retention, removal and replacement of individual fluid reservoirs or cartridges, for example one or more individual retention clips 72 for individually activated (e.g., day and night treatment) fluid reservoirs, and one more assembly retention clips 73 for an assembly of two or more simultaneously actuated (e.g., serum treatment) fluid reservoirs. Retention clips 72 and 73 can be spring biased or similarly manually actuated, for example with a combination of ejection springs 75, plunger components 76, 77, 78 and dowel pins, screws or other mechanical fasteners 74 and 79 to couple the various components of well assembly 46 together, and to control retention and ejection of the cartridge assembly and individual fluid reservoirs from well housing 71.

In some designs, one or more compliance units 80 may also be provided to limit or reduce stress on the drive components, for example in the case of a stuck cartridge or over-travel of the selectively actuated drive mechanisms. As shown in FIG. 7, compliance units (or mechanisms) 80 include a top component or cap 80A, bottom component or base 80B, and a spring or bias component 80C. In this particular configuration, top cap 80A and base component 80B of compliance units 80 snap together or otherwise couple together to pre-compress internal bias components 80C, and individual compliance units 80 are provided for each of the individually selected cartridge reservoirs, as described below. Alternatively, one or more compliance units 80 may also be provided for the cartridge assembly, in order to limit or reduce stress on the corresponding assembly drive.

Drivers

Figure 8:
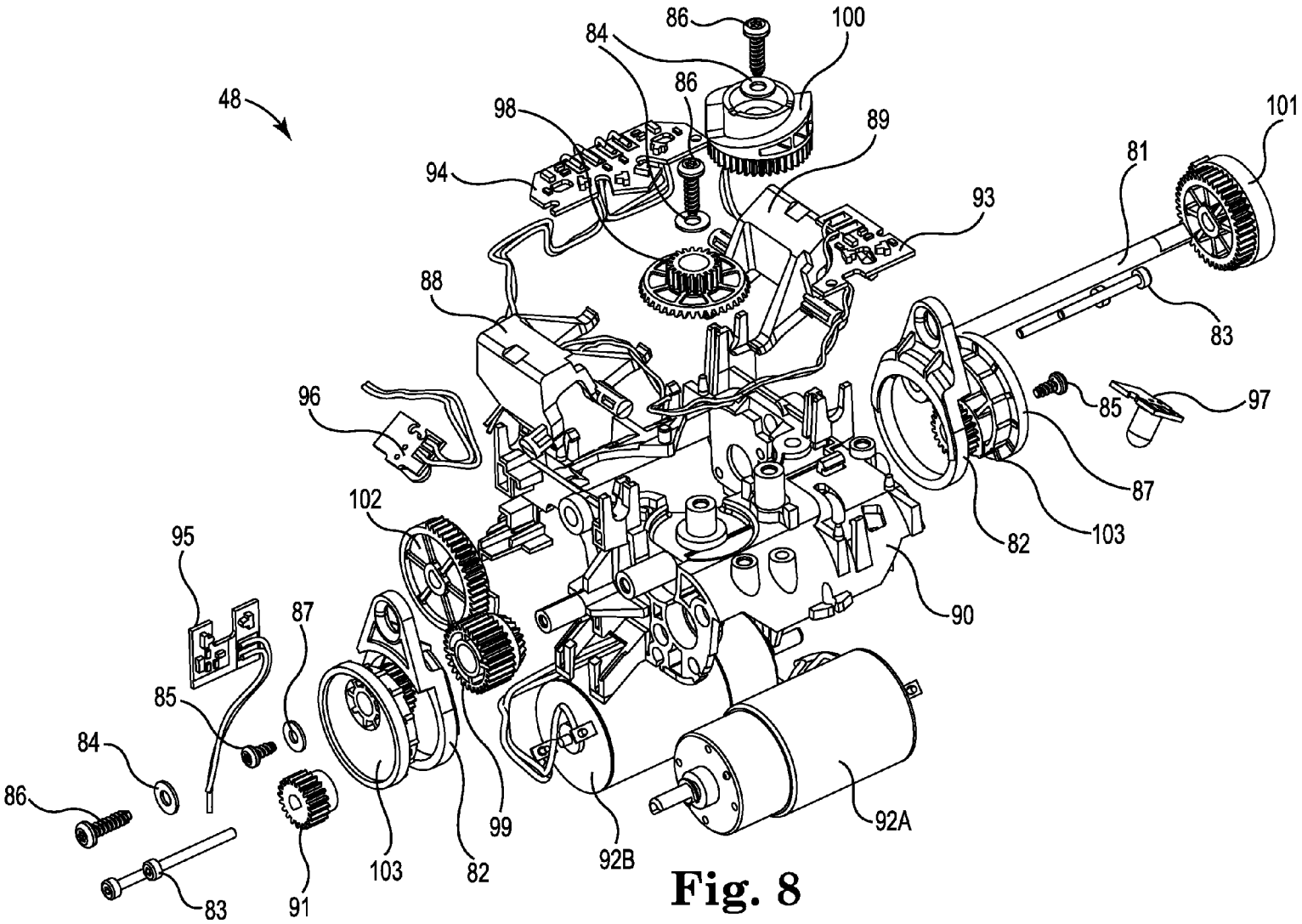
FIG. 8 is an exploded view of a pump motor or drive assembly for the fluid dispensing system.

FIG. 8 is an exploded view of the pump motor or drive assembly 48 for fluid dispensing system 10. As shown in FIG. 8, drive assembly 48 includes drive shaft 81, left and right connecting rods (conrods) or actuators 82, screws, washers, and other mechanical fasteners or coupling components 83-87, left and right actuator levers 88 and 89, motor or drive chassis 90, and gear drive or drive train components including one or more spur gears 91 and (e.g., electric) motors 92A and 92B. The purpose of the drive assembly 48 is to provide selective actuation of a pumping mechanism that is associated with each reservoir, whether individual or in a reservoir group joined by a manifold. In one embodiment, the pumping mechanism is based on a reciprocating linear pump stroke that may be driven by a cam, lever or similar assembly, ultimately driven by one of motors 92A and 92B, acting through a drive train and actuator to cause the reciprocating linear pump stroke.

Drive assembly 48 may also include sensor components configured to detect the positions or actuator states of the various selectively actuated drive components. In one embodiment sensor 95 senses the rotational position of half gear 102 by detecting a partial flange on the circumference of half gear 102. Sensors on circuit component 94 sense plungers 78 for installation of day and night cartridge, and sensors on circuit component 93 sense additional plungers (see FIGS. 12 and 13) for the serum cartridge assembly. Additional embodiments are also encompassed, including cartridge assembly sensor electronics 93 for detecting the actuator position or state of the mixed fluid dispenser cartridge assembly, individual cartridge sensor electronics 94 for detecting the actuator position or state of the individually selected dispenser cartridges, and "home" sensor electronics 95 for detecting the corresponding "home" or "zero" cartridge actuator position. A proximity sensor system is also provided to detect the user's hand or other object in the dispensing opening, for example with IR emitter 96 and a corresponding sensor 97, or using corresponding IR, optical, capacitive, or motion detector components 36 and 37, as described above with respect to FIG. 3.

The fluid cartridge or reservoir actuator or pump driver configurations may vary, along with the corresponding drive train components. In the particular configuration of FIG. 8, for example, drive assembly 48 includes one or more bevel gears 98 and 99 of various sizes, a spiral cam 100 configured for driving the mixed fluid cartridge assembly (e.g., with two or more simultaneously actuated treatment or serum cartridges), with drive gear 101 and half gearing on gear components 101 and 102 coupled to shaft 81 with the half gears clocked or timed to drive individual cam gears 103 for each of left and right levers 88 and 89, for selectively dispensing fluid from individual (e.g., day and night) fluid reservoirs. In this embodiment, drive assembly 48 provides separate drive trains for the individually selected fluid reservoirs and the simultaneously actuated (mixed) fluid reservoir assembly, as described below.

Figure 9:
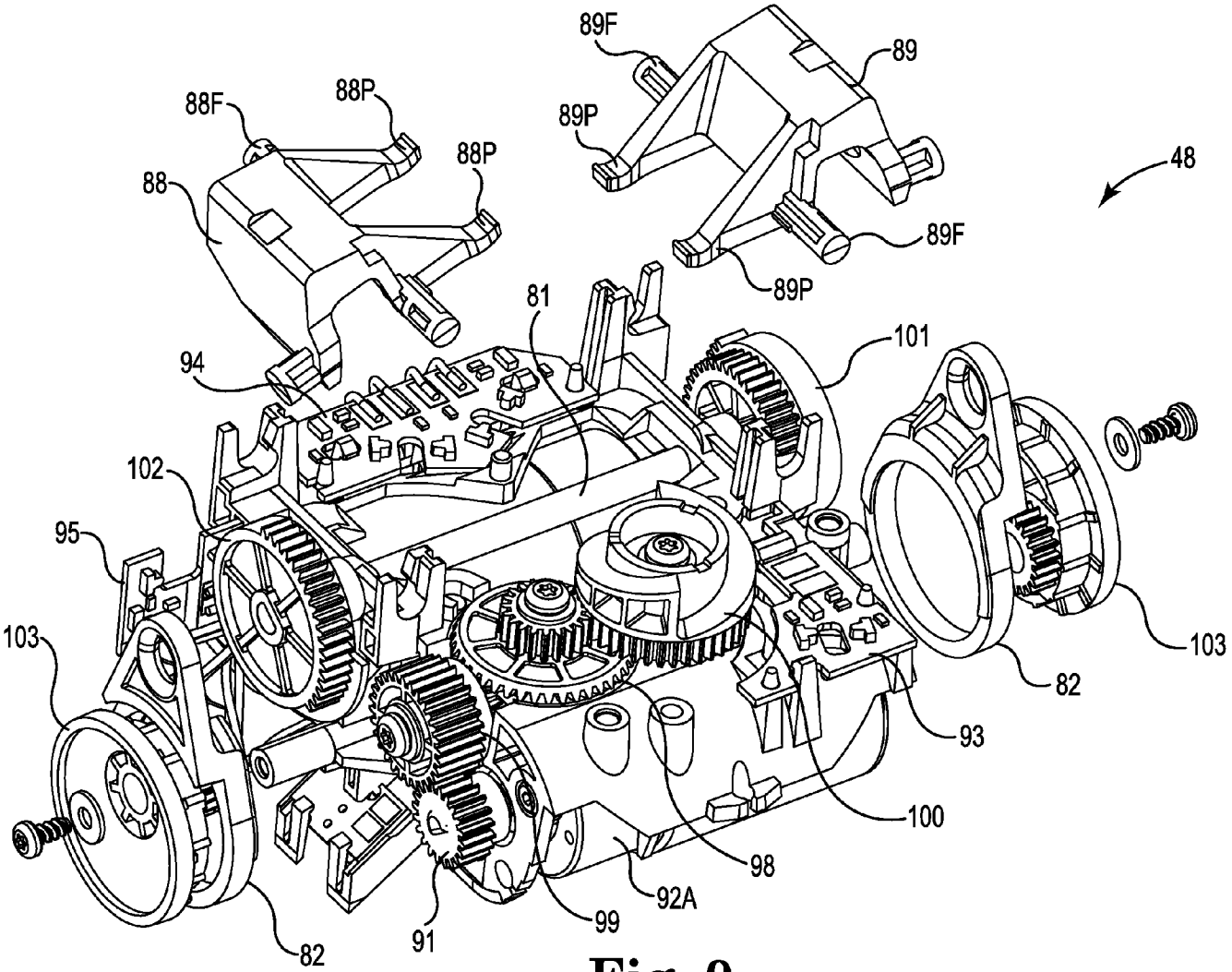
FIG. 9 is a detail view of the pump driver assembly, in partially assembled form.

FIG. 9 is a detail view of drive assembly 48, in a partially assembled form. In this view, motors 92A/92B and selected drive train components are mounted to drive chassis 90, along with spiral cam 100. Left and right levers 88 and 89, conrods or actuators 82, and cam gears 103 are shown in a disassembled configuration.

Figure 10:
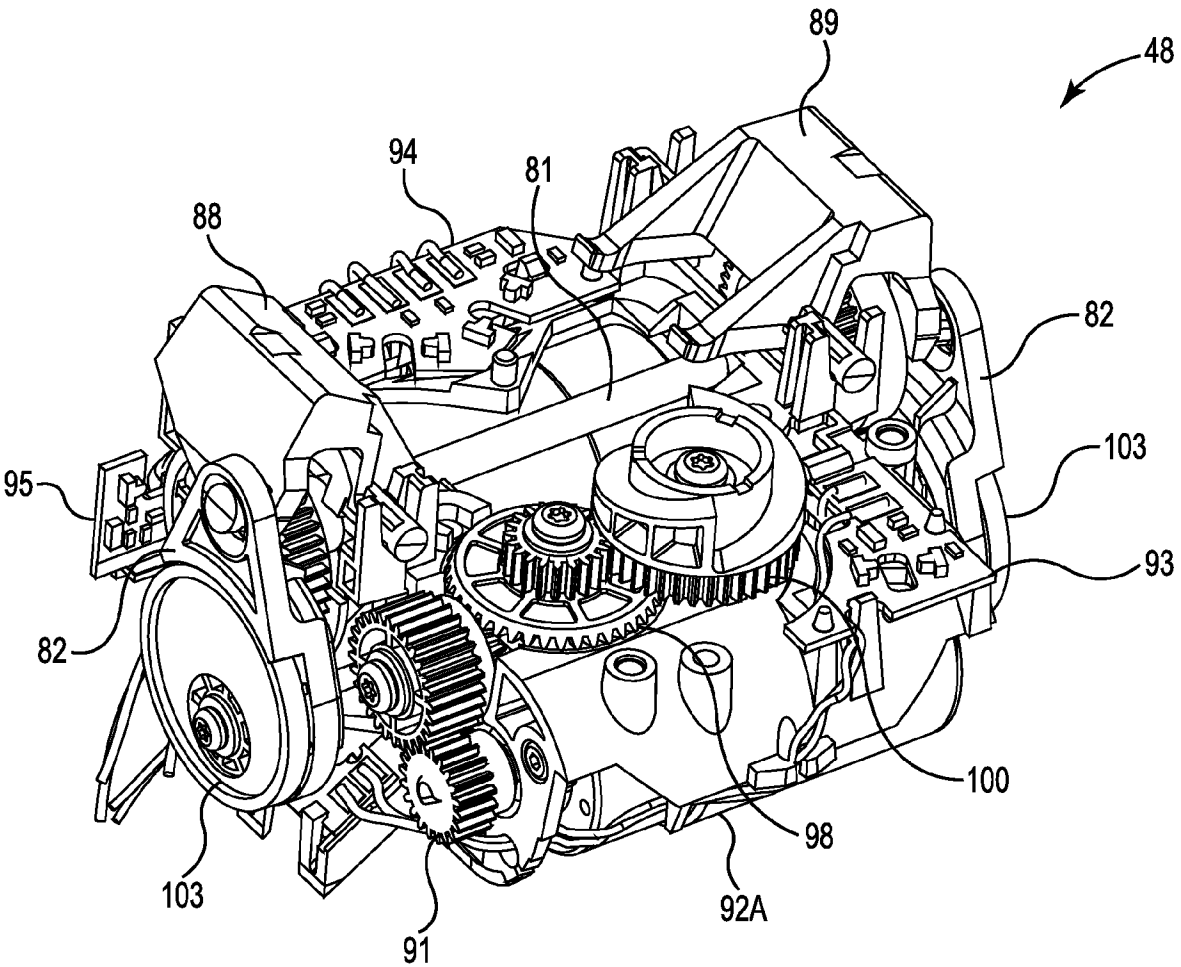
FIG. 10 is an assembled view of the pump driver assemblies, illustrating the drive train mechanics and sensors.

FIG. 10 is a fully assembled view of pump drive 48, illustrating the drive train linkages for the fluid reservoir pumping mechanisms. As shown in FIGS. 9 and 10, there are separate drive trains for the individually actuated (or selected) fluid reservoirs, and for the simultaneously actuated (mixed) fluid reservoirs.

The individual fluid reservoir drive train includes drive shaft 81 rotationally coupled to motor 92A, for example via drive gear 101. Drive gear 101 and half gear 102 are positioned on opposite ends of drive shaft 81, for example with complementary half-gearing teeth clocked at ±180°. When motor 92A is selectively controlled to rotate drive shaft 81 in a first direction or sense (e.g., clockwise, for up to about +180°), the clocked half gearing on drive gear 101 engages the corresponding eccentrically mounted cam gear 103 to drive conrod actuator 82 up, pivoting right lever 89 up in a "see-saw" fashion about fulcrum 89F. Motor 92A then rotates drive shaft 81 back toward the zero or home position (e.g., detected by home sensor electronics 95), engaging the corresponding cam gear 103 to the corresponding conrod actuator 82, pivoting right lever 89 down about fulcrum 89F.

During this portion of the cycle, the half gearing on gear 102 may be disengaged from the corresponding eccentric cam gear 103 and conrod actuator 82, so that left lever 88 remains substantially stationary while right lever 89 is pivoted or actuated up and down. Motor 92A can also be selectively controlled to rotate drive shaft 81 in a second direction or sense (e.g., counterclockwise, for up to about −180°, so that the clocked half gearing on gear 102 engages the corresponding cam gear 103 and conrod actuator 82 to pivot left lever 88 up about fulcrum 88F. Motor 92A then rotates drive shaft 81 back toward the zero or home position, in order to pivot left lever 88 back down, with the half gearing on gear 101 being disengaged.

Similarly, the half gearing on gear 101 may be disengaged from the corresponding eccentric cam gear 103 and conrod actuator 82 during its portion of the cycle, so that right lever 89 remains substantially stationary while left lever 88 is pivoted or actuated up and down. Thus, left and right levers 88 and 89 may be individually actuated to selectively dispense fluid from different cartridge reservoirs. Alternatively, a complete or unclocked gearing may be provided on gears 101 and 102, and right and left levers 88 and 89 may be simultaneously actuated up and down, in the same or opposite sense.

The mixed fluid reservoir drive train includes motor 92B coupled to spur gear 91, bevel gears 98 and 99, and spiral cam 100. Spiral cam 100 engages a corresponding fixed cam with a complementary surface on the mixed fluid cartridge assembly, in order to simultaneously actuate two or more fluid reservoirs to dispense a mixed fluid.

Drive motor 92B can thus be selectively controlled to drive spiral cam 100 in rotational and/or reciprocating motion, in order to control the mixed fluid dispensing process independently of the individually selected fluid dispensing steps. For example, a current sensor or other sensing electronics 93 can be used to limit the rotational motion to an angular range of about 160° (or ±160°), depending on spiral cam configuration and desired stroke amplitude.

For example, when the sensor current reaches a known or predetermined threshold to indicate that the pumping action has completed a stroke, the controller can reverse the motor action responsive to the condition that the stroke is completed or the pump has bottomed out. Alternatively, the rotational or reciprocating motion range may vary, and other sensing technologies may be used, such as a rotary encoder. In additional embodiments, a single motor 92A or 92B may be used, for example with a selective coupling or engagement configured to drive one or both of the individual fluid reservoir drive train and the mixed fluid cartridge drive train.

Reservoirs, Cartridges and Selected Reservoir Sets or Subsets

Figure 11:
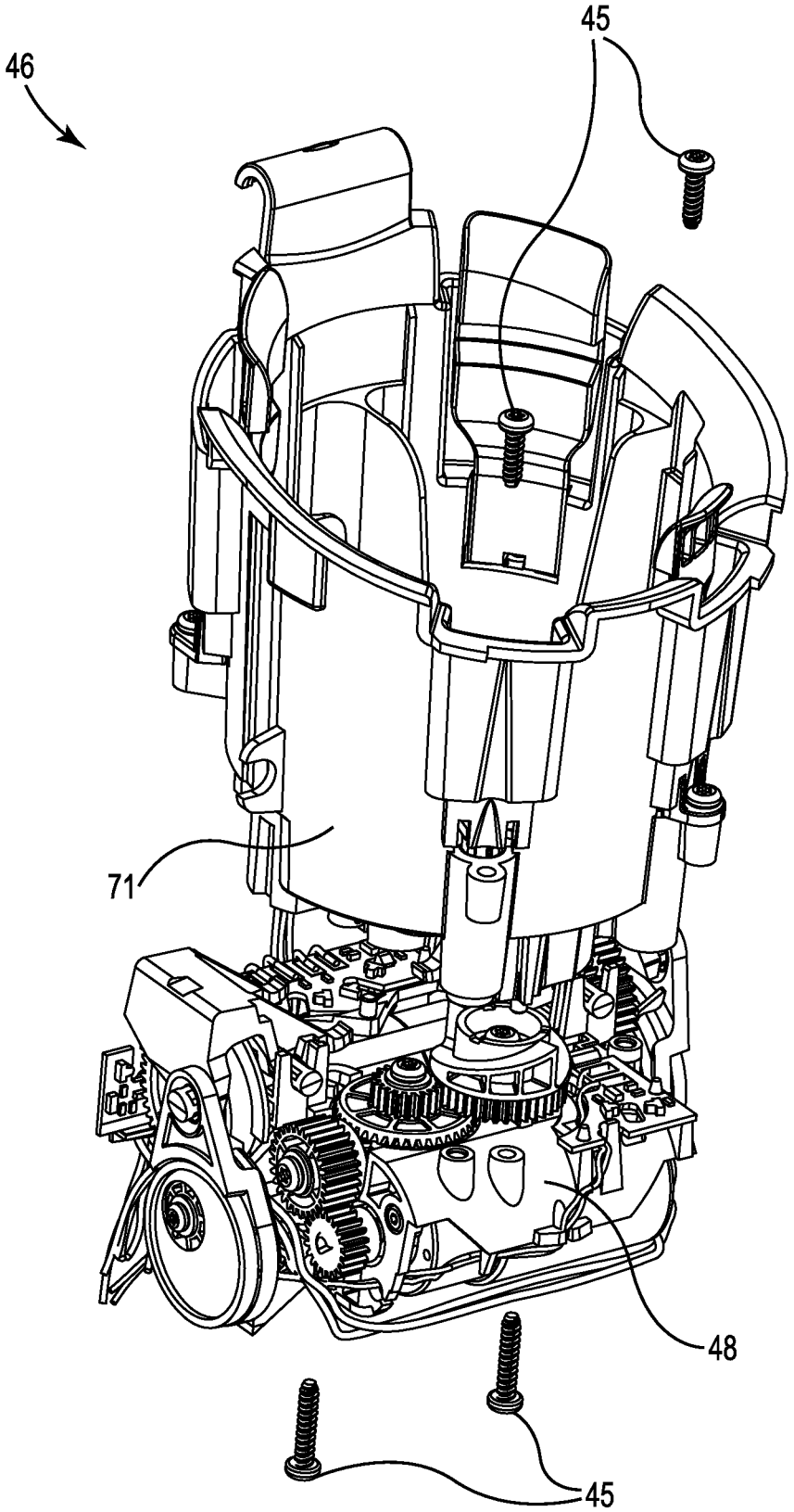
FIG. 11 is an exploded view of the well assembly and pump driver assembly.

FIG. 11 is an exploded view of well assembly 46 and pump drive 48. As shown in FIG. 11, pump drive assembly 48 is coupled to the bottom portion of well housing 71, for example using one or more mechanical fasteners 45, in order to engage the corresponding drive train mechanisms with one or more individual fluid reservoirs and mixed fluid cartridge assemblies within well assembly 46.

Figure 12:
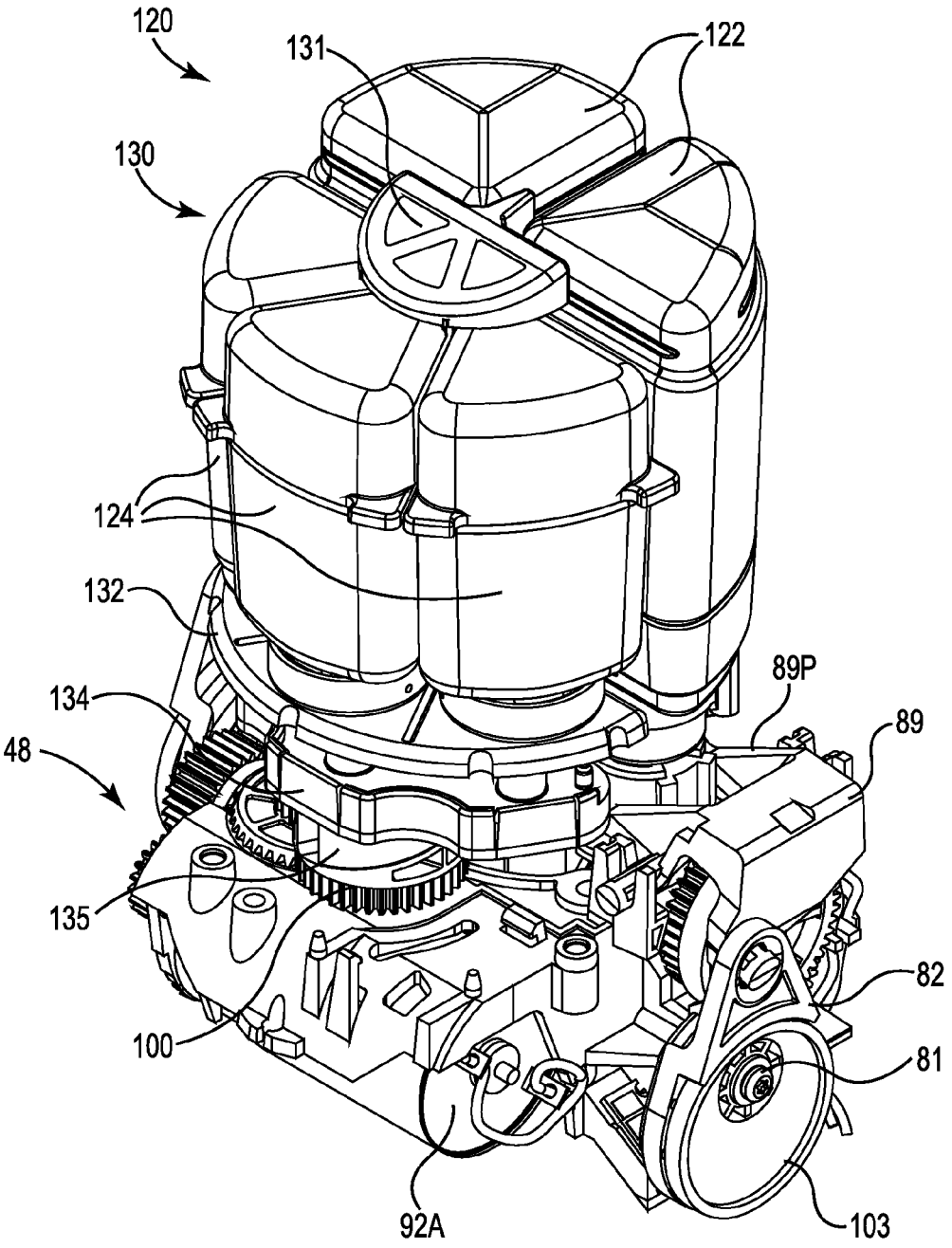
FIG. 12 is a perspective view of a pump driver assembly and fluid reservoir assembly for the fluid dispensing system, with the well removed for clarity.

FIG. 12 is a perspective view of pump drive assembly 48 and fluid reservoir assembly 120 for fluid dispensing system 10, with the well and plunger components removed for clarity. In this particular embodiment, two selectively (or individually) actuated fluid reservoirs 122 are provided, along with three simultaneously actuated fluid reservoirs 124.

In the "close packed" configuration of FIG. 12, individual reservoirs or cartridges 122 each have a substantially right triangular or wedge-shaped cross section with an arcuate outer perimeter, and occupy about 90° of circumference of the cartridge assembly (and corresponding opening area of the well). Simultaneously actuated (mixed) fluid cartridges 124 have similar arcuate-wedge shaped cross sections, with each occupying about 60° of the circumference. Alternatively, the number and dimensions of the individual fluid cartridges and reservoirs vary. For example, individual cartridges or reservoirs 122 and 124 may have cylindrical, rectangular, oblong, oval, or other cross sections, or other geometries.

Cartridges and reservoirs 122 and 124 can also be provided with internal pumping mechanisms, for example utilizing an internal bladder or bag with a rigid outer wall or shell and spring-loaded plunger. In one embodiment, a pump is implemented in each cartridge in the form of a linear-motion piston, paired with a dispensing conduit with an outlet. In some pumps the conduit is linked to or part of a piston that, as it is displaced inward in a cartridge, it causes a measured or metered (e.g., preselected) amount of liquid to be pumped form the outlet. The amount of the liquid pumped is proportional to the length of the pumping stroke and the length of the pumping stroke is determined by a pushing motion generated in pump driver assembly 48, comprising a motor operably connected via a drive train to the linear motion piston of the pump. As illustrated in FIG. 12, for example, the pumping mechanisms in a first subset of individual fluid reservoirs or cartridges 122 can be selectively actuated via a coupling to lever mechanism 88 (or 89), using a preloaded bias mechanism 80 as described above.

A second subset of fluid reservoirs or cartridges 124 (each may be implemented with a pump in the form of a linear-motion piston, paired with a dispensing conduit with an outlet) can be simultaneously actuated for pumping action that mixes fluid from two or more cartridges in a separate subassembly (or cartridge assembly) 130, coupled together via a vertical cartridge coupling member or spline 131 and a bottom connector or plate 132. A serum connector or mix manifold 134 is also provided, with a fixed cam 135 coupled to spiral cam 100 of drive assembly 48, so that rotation of spiral cam simultaneously actuates the pumping mechanism in each fluid reservoir or cartridge 124 of the second subset, mixing the fluids together in manifold 134 as described below.

Figure 13:
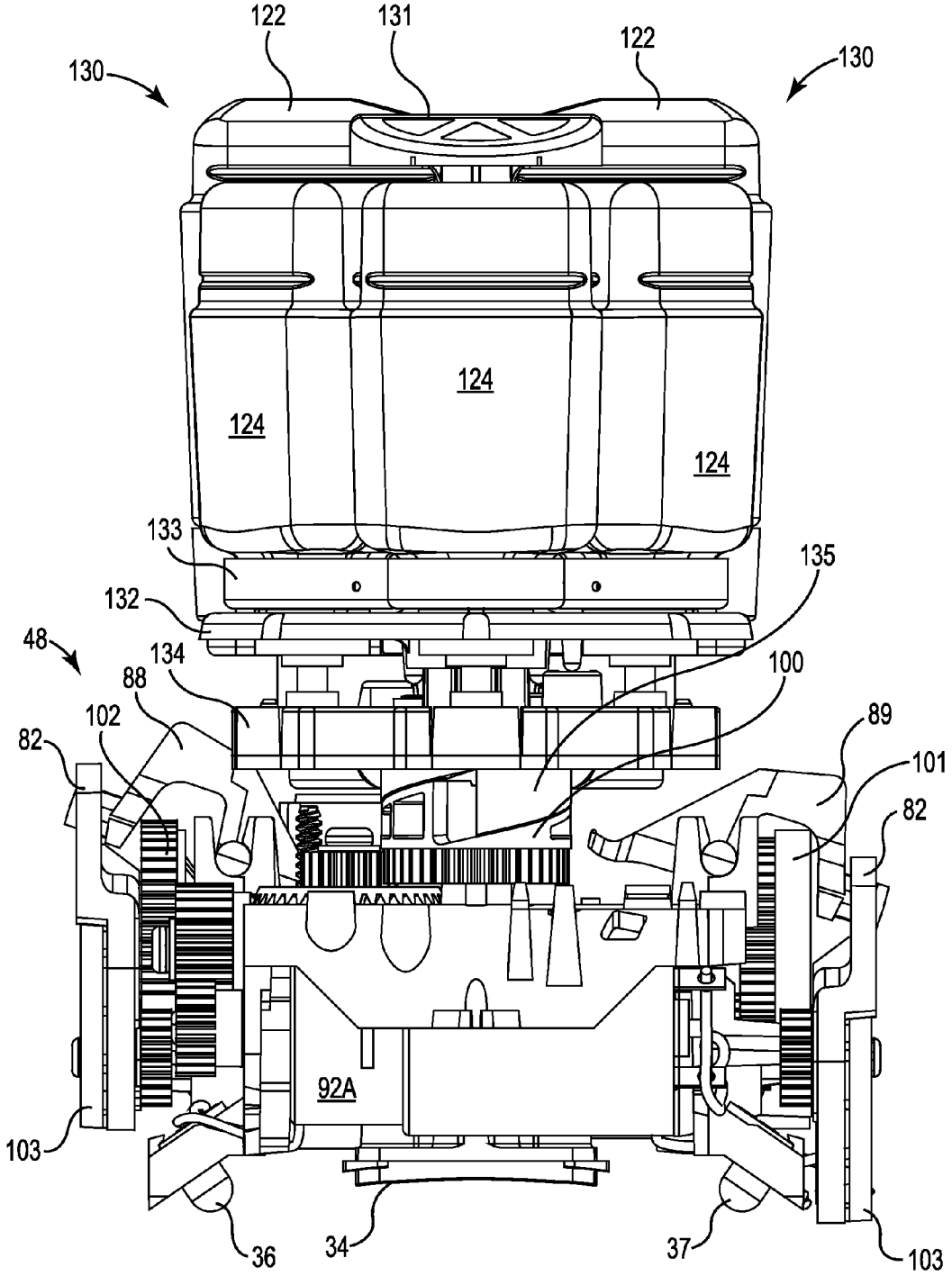
FIG. 13 is a front view of the pump driver assembly and fluid reservoir assembly, with the well removed.

FIG. 13 is a front view of pump drive assembly 48 and fluid reservoir assembly 120, showing simultaneously actuated fluid cartridges 124 coupled together into cartridge assembly 130 with spline top connector 131 and bottom holder plate 132. Each cartridge 124 has a bottom fitting 133 configured to mate with bottom holder plate 132. Each bottom fitting is adapted for insertion in one of at least two holder openings in the bottom holder plate 132. Each cartridge 124 also has a top fitting for engagement with the top connection 131, which lies generally parallel to and spaced from the holder plate 132. Each cartridge 124 also has a pump outlet conduit extending from the bottom fitting and adapted for fluid communication connection to an inlet of mix manifold 134, which is connectable also to at least one other cartridge of the second subset with another flowable liquid. The pump outlet conduit is connected to a dispenser pump for reciprocating, inward and outward travel. Each dispenser pump is actuated by inward travel of the conduit to dispense a metered amount of the contained, flowable liquid from an outlet of the conduit into a mixing flow path of the manifold 134 that receives fluid from the outlet of two or more dispenser pumps. Pumping mechanism conduits on each cartridge 124 extend through bottom holder plate 132, with the conduits making a fluid seal with corresponding inlets on mix manifold 134 (see FIGS. 19 and 20, below).

The lower portion of mix manifold 134 includes fixed cam structure 135. Fixed cam 135 and spiral cam 100 are provided with complementary sliding surfaces, which engage to convert the rotational motion of spiral cam 100 inter linear (vertical) motion of mix manifold 134. Mix manifold 134 thus undergoes a linear (or vertical) oscillating stroke when spiral cam 100 is rotated in reciprocal motion by drive assembly 124, simultaneously actuating the pumping mechanism on each fluid reservoir or cartridge 124 connected to the manifold 134. The individual fluids from the two or more different cartridges 124 are mixed together within manifold 134, for dispensing to the user from the single outlet of the manifold.

Figure 14:
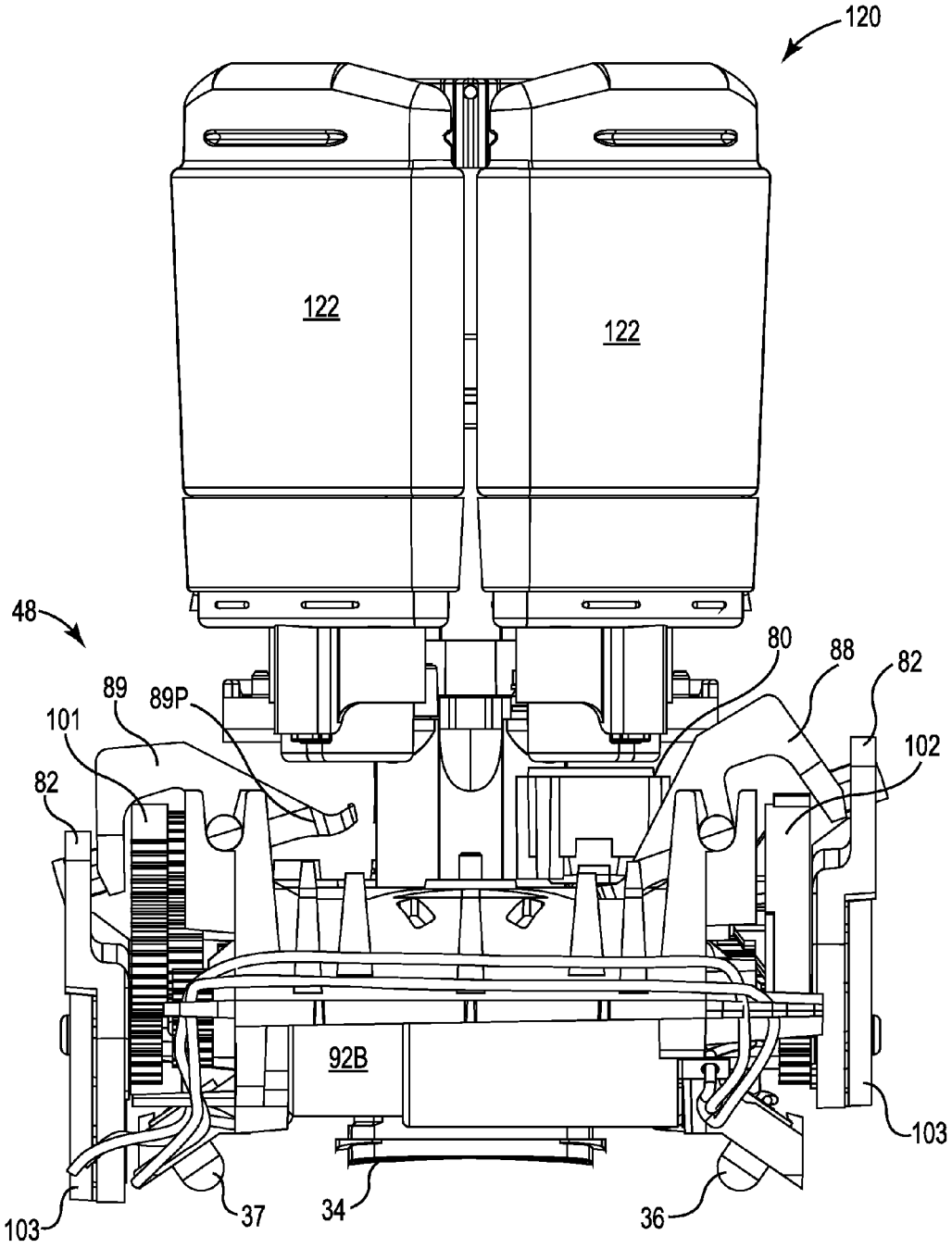
FIG. 14 is a rear view of the pump driver assembly and fluid reservoir assembly, with the well removed.

FIG. 14 is a rear view of pump drive assembly 48 and fluid cartridge assembly 120, showing individually actuated fluid reservoirs or cartridges 122. As shown in FIG. 14, individual cartridges 122 are coupled to pump drive assembly 48 via a compliance unit or bias mechanism 80, which in turn are coupled to tines or forks ("prongs") on the lever mechanisms, as shown for prongs 89P on right-side lever 89.

Left-side lever 88 is shown in a decoupled configuration, without compliance unit 80, in order to illustrate the structure of prongs 88P. Cartridges 122 can thus be selectively actuated to dispense individual fluids, for example by controlling drive assembly 48 to selectively rotate cam gears 103 and position conrod actuators 82 to tilt one or the other of individual left and right-side levers 88 and 89, as described above.

Figure 15:
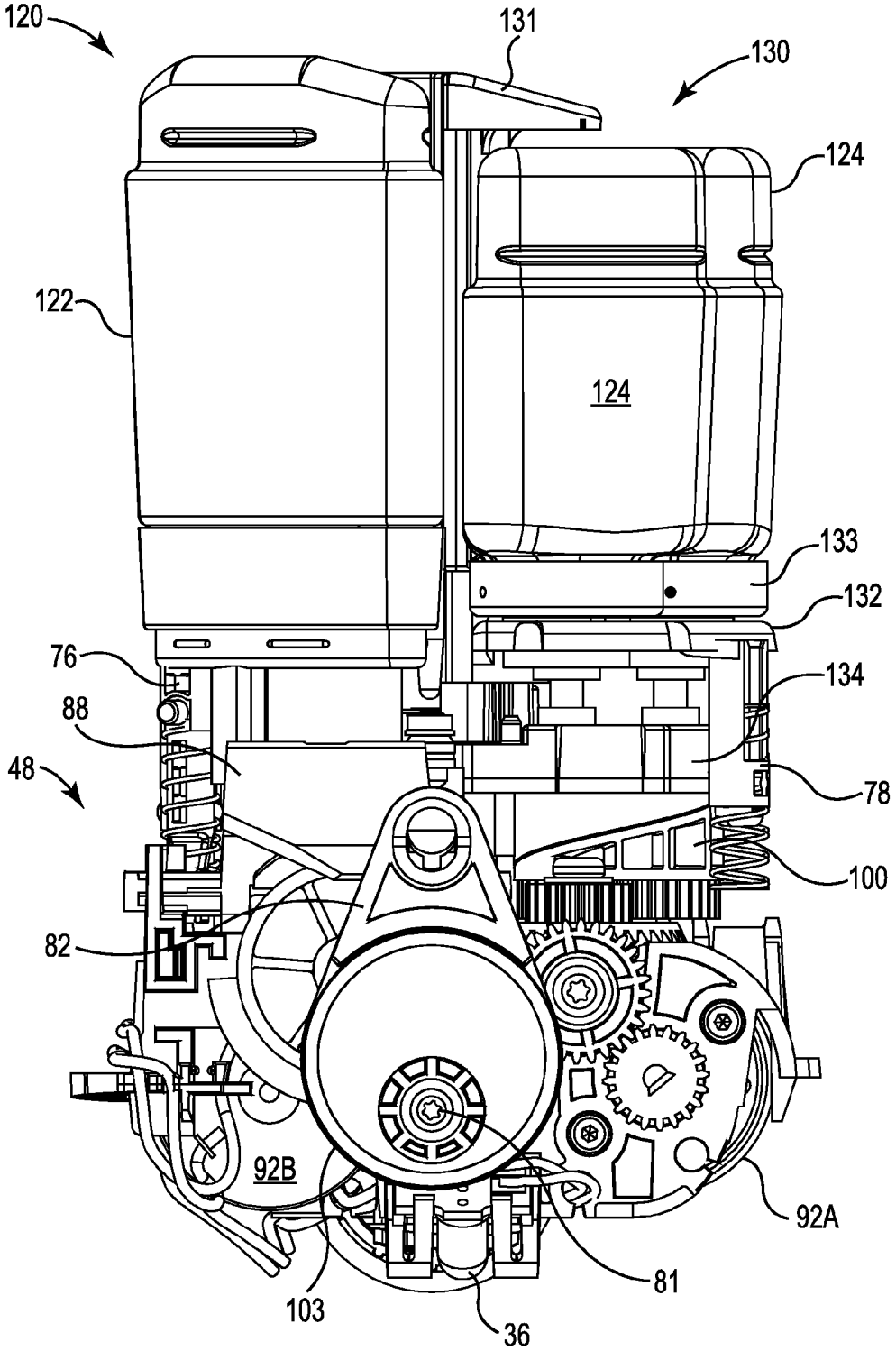
FIG. 15 is a left side view of the pump driver assembly and fluid reservoir assembly, with the well removed.

FIG. 15 is a left side view of pump drive 48 and fluid cartridge assembly 120. In this particular configuration, left-side cam gear 103 is rotated to position left-side actuator (or connecting rod) 82 upward, tilting the prongs of left-side lever 88 down as shown in FIG. 14. Representative plunger components 76 and 78 are shown in FIG. 15, in order to illustrate selected cartridge ejection components. The dimensions and positions of these components vary, depending cartridge position and coupling to the well structure (see FIG. 7).

Figure 16:
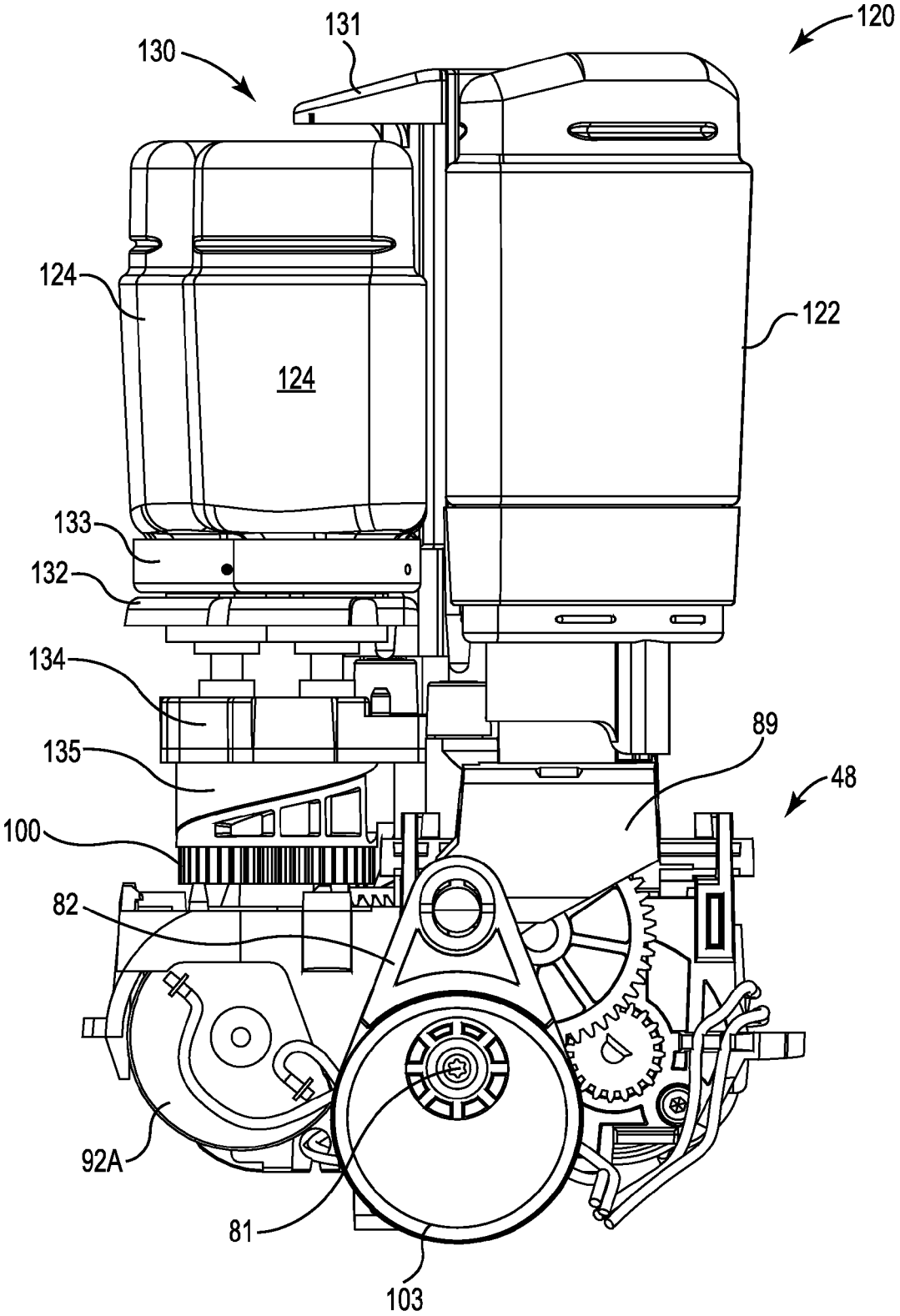
FIG. 16 is a right side view of the pump driver assembly and fluid reservoir assembly, with the well removed.

FIG. 16 is a right side view of pump drive 48 and fluid cartridge assembly 120. In this configuration, right-side cam gear 103 is rotated to position right-side actuator (or connecting rod) 82 downward, tilting the prongs of left-side lever 89 up as shown in FIG. 14.

Figure 17:
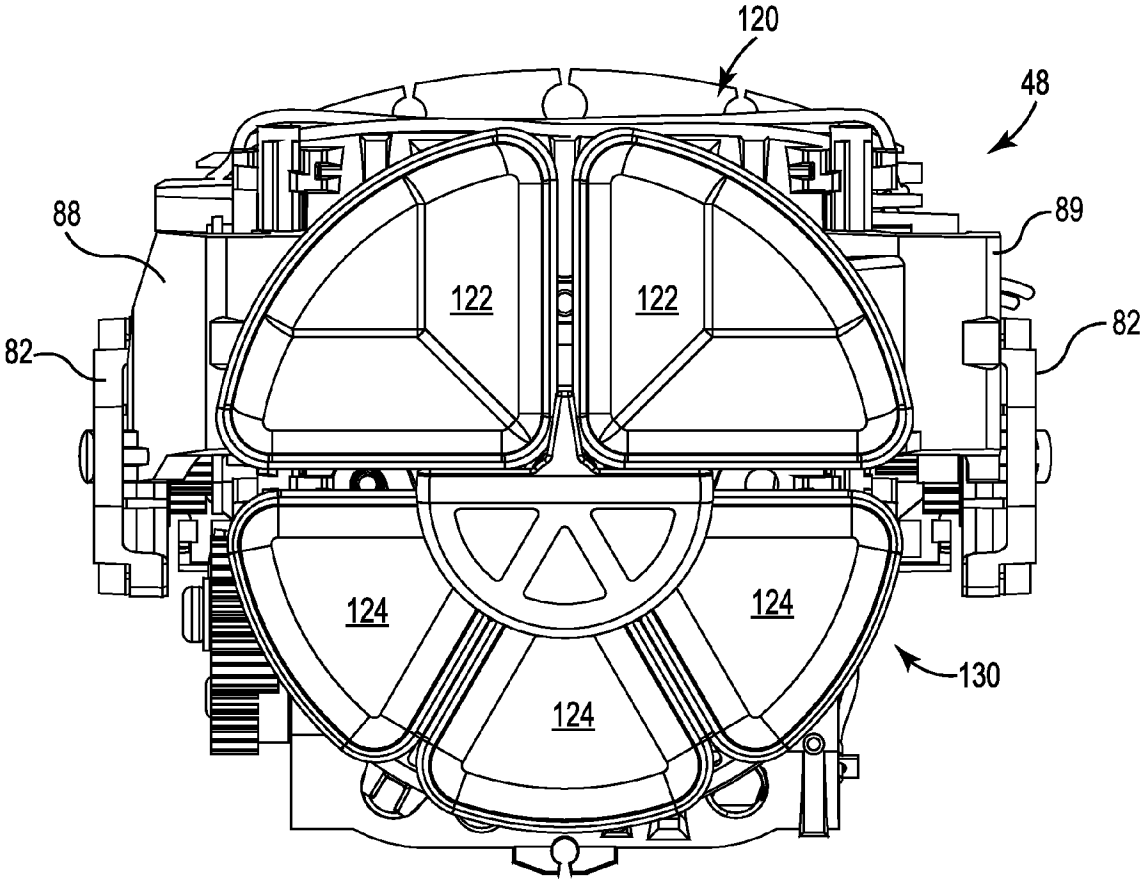
FIG. 17 is a top view of the pump driver assembly and fluid reservoir assembly, with the well removed.

FIG. 17 is a top view of pump drive 48 and fluid cartridge assembly 120, showing close-packed configuration for efficient use of the well volume. Individually selected fluid reservoirs 122 are positioned in a side-by-side configuration at the top of FIG. 17, occupying approximately the upper 180° of the circumference of assembly 120 (that is, the top half of the well area and well volume). Simultaneously actuated fluid reservoirs 124 are positioned in a corresponding side-by-side configuration at the bottom of FIG. 17, occupying approximately the lower 180° of the circumference of assembly 120 (approximately the bottom half of the well area and well volume).

Figure 18:
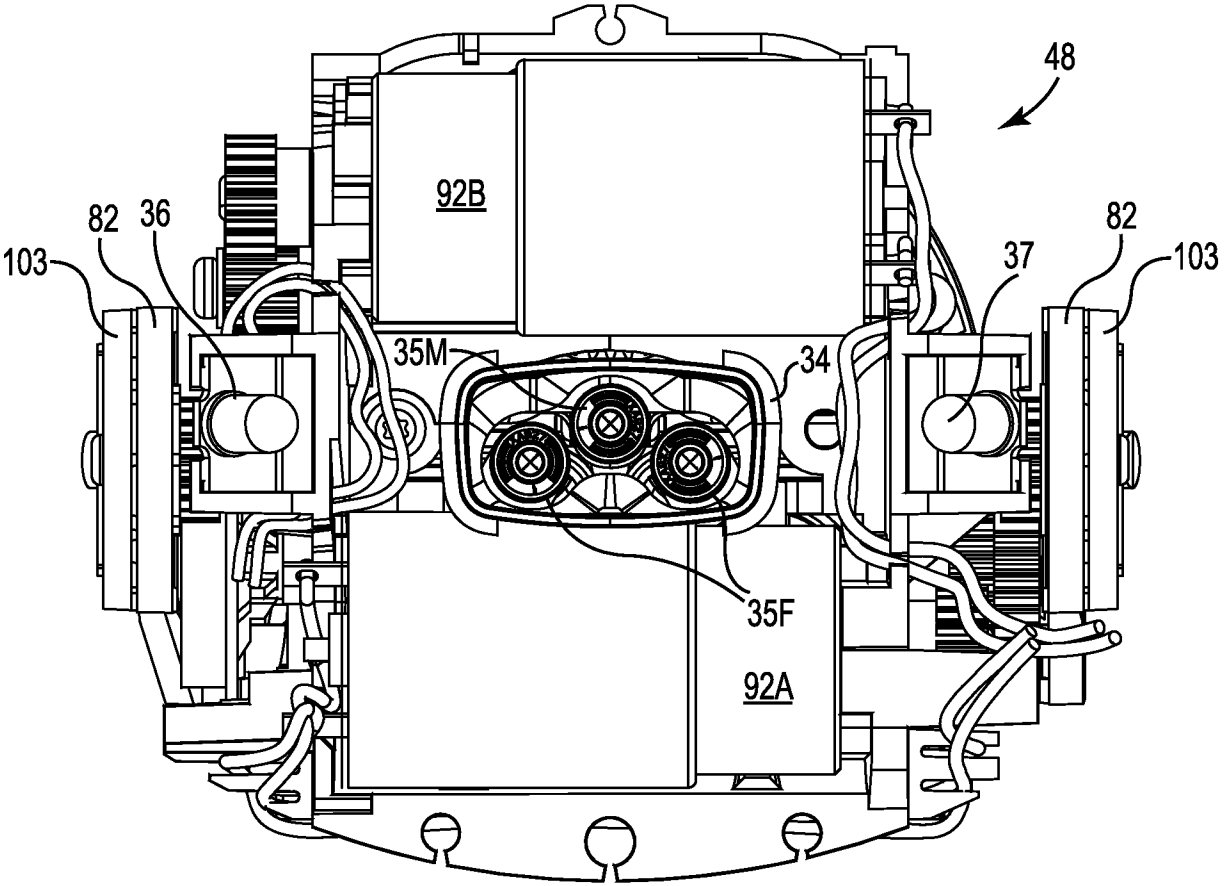
FIG. 18 is a bottom view of the pump driver assembly and fluid reservoir assembly.

FIG. 18 is a bottom view of pump drive assembly 48 and fluid cartridge assembly 120. As shown in FIG. 18, individual motors 12A and 12B are provided to drive separate gear trains for the individually selected and simultaneously actuated subsets of fluid reservoirs. In addition, each individually actuated fluid reservoir is coupled to a separate dispensing nozzle or aperture 35F. Fluid from the simultaneously actuated reservoirs is mixed within the manifold, and dispensed from a single nozzle or aperture 35M.

Fluid Cartridge Assemblies

Figure 19:
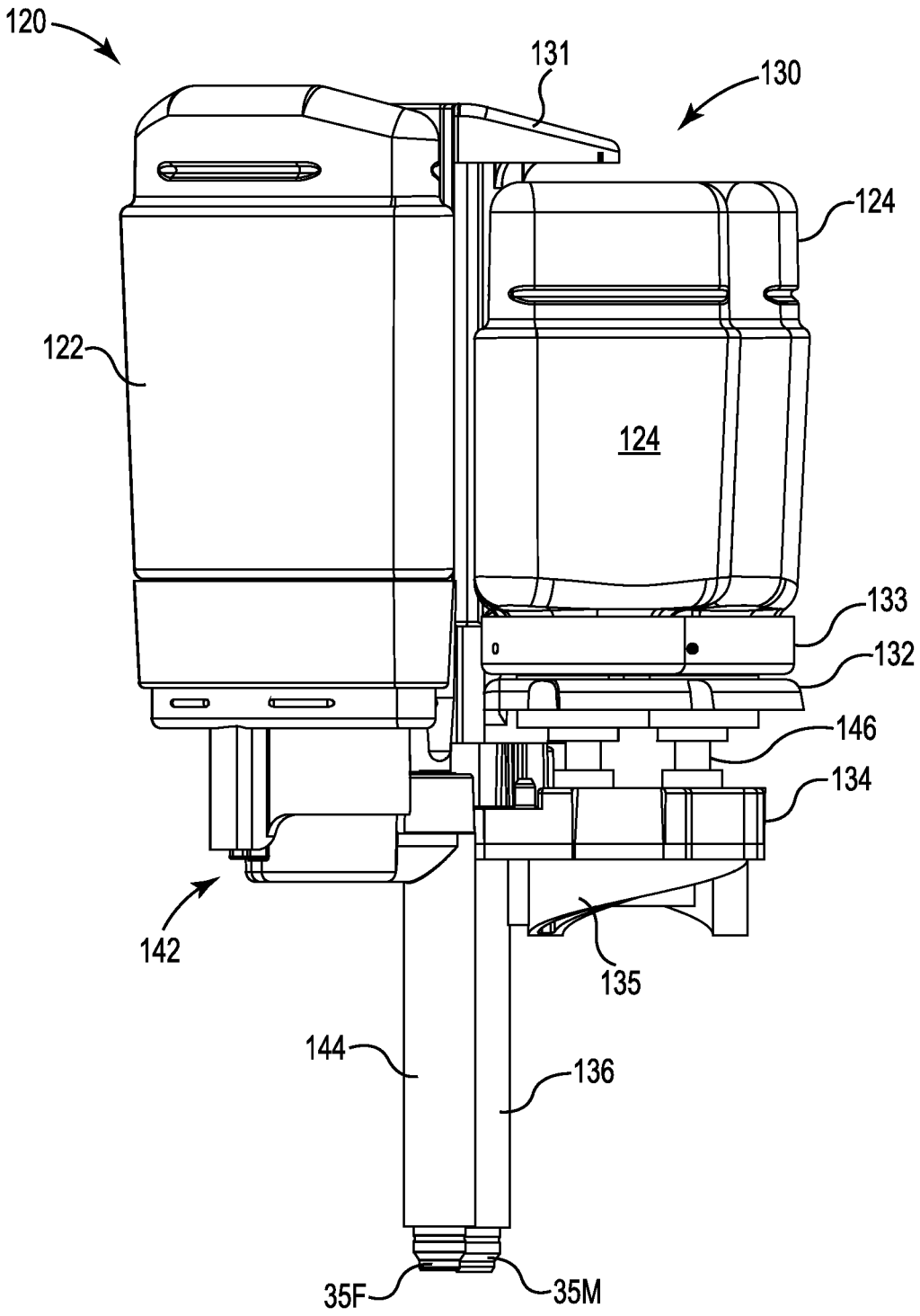
FIG. 19 is a side view of the fluid reservoir or cartridge assembly.

FIG. 19 is a side view of the fluid cartridge assembly. As shown in FIG. 19, each individually actuated (e.g., night and day) cartridge or fluid reservoir 122 can be provided with an internal pumping mechanism 142 and stem extension 144, including dispensing nozzle 35F. This provides for increased hygiene and sanitary operation of the dispensing system, because the entire fluid flow pathway for each cartridge 122 may be provided in single-use (or disposable) form, reducing the risk of cross-contamination. As used herein, "single-use" encompasses multiple dispensing operations from a particular reservoir, which may then be replaced when empty, at a particular date, or otherwise according to user preference.

Figure 20:
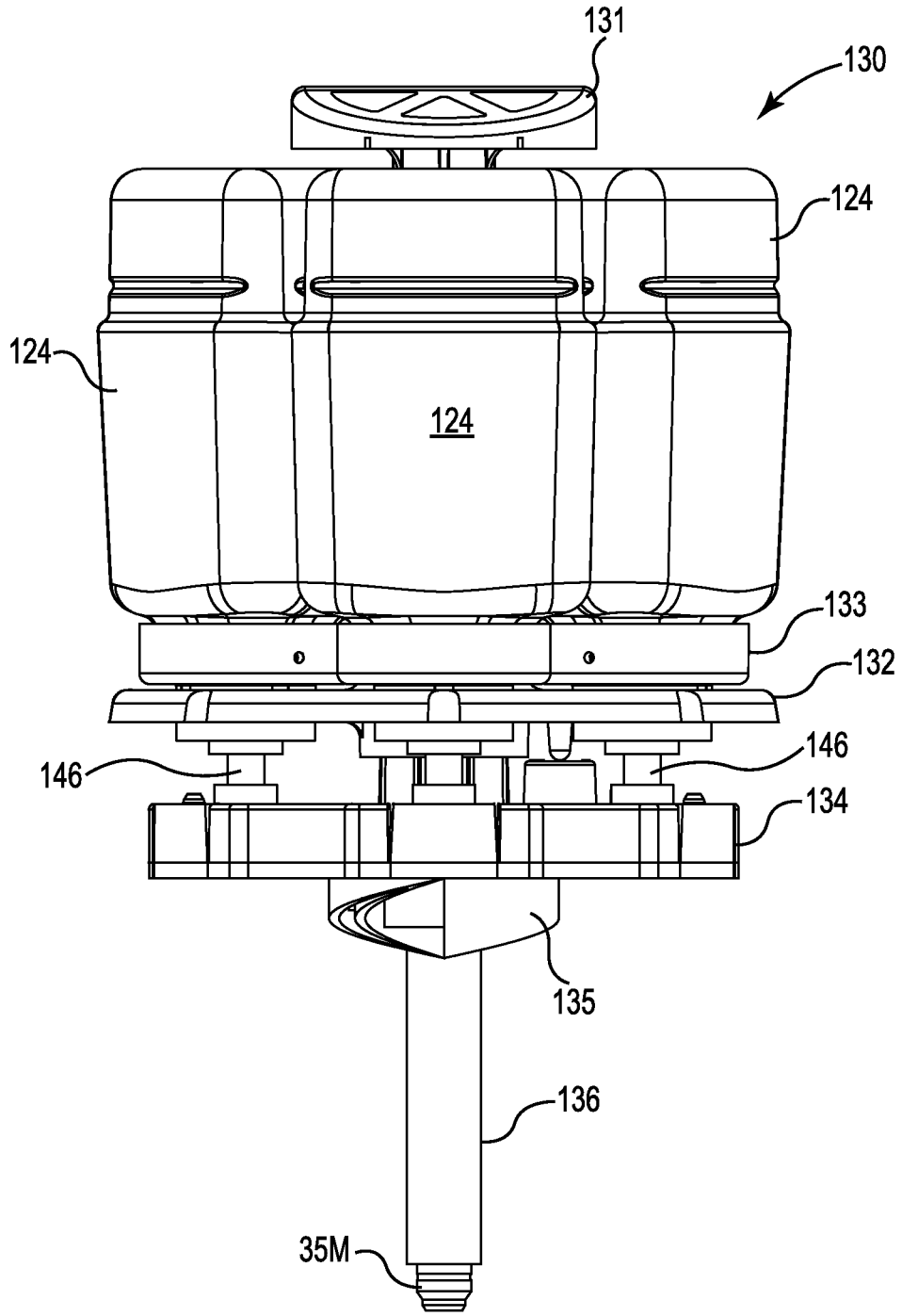
FIG. 20 is a front view of a simultaneously actuated fluid cartridge subassembly.

FIG. 20 is a front view of a simultaneously actuated cartridge assembly (or subassembly) 130. As noted above, each fluid reservoir or cartridge 124 includes an individual pumping mechanism, for example a spring-actuated piston/plunger with conduit 146 extending through lower plate or bottom connector plate 132 to a make a fluid seal against a corresponding inlet of mix manifold 134.

As shown in FIG. 20, cartridge assembly 130 can also be provided in a single-use or disposable form, including two or more simultaneously actuated (e.g., serum treatment) cartridges or fluid reservoirs 124, as well as spline top connector 131, bottom plate 132 and mix manifold 134 extending to bottom stem 136 with mixed fluid nozzle 35M. Thus, the entire mixed fluid pathway can also be provided in single-use or disposable form, decreasing the risk of cross-contamination for improved sanitary and hygienic operation as described above.

Figure 21:
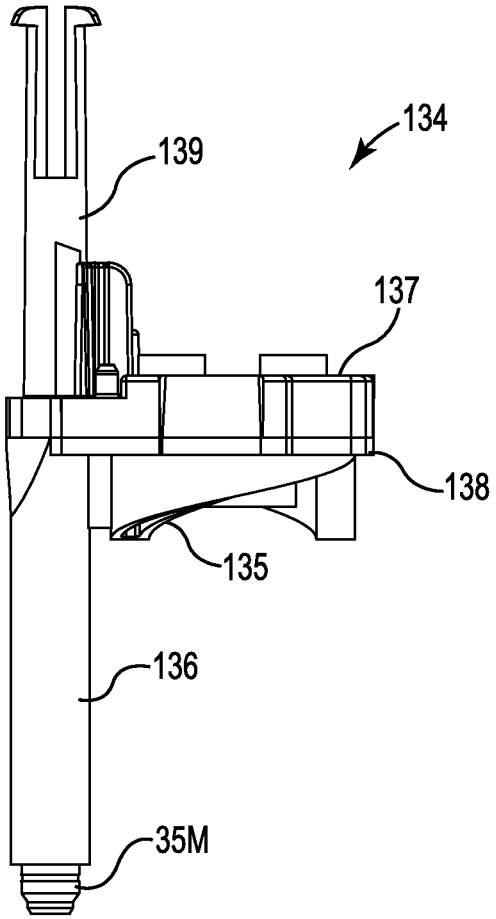
FIG. 21 is a side view of a mix manifold or serum connector for the fluid cartridge subassembly of FIG. 20.

FIG. 21 is a side view of mix manifold 134 for fluid cartridge assembly 130. In this embodiment, mix manifold 134 includes top portion 137 and bottom portion 138. Top portion or section 137 of mix manifold 134 includes extension 139 for coupling to spline top connector 131 (see FIG. 20). Bottom section 138 of mix manifold 134 includes fixed cam 135, and extends to lower stem 136 and mixed fluid dispensing nozzle 35M.

Figure 22A:
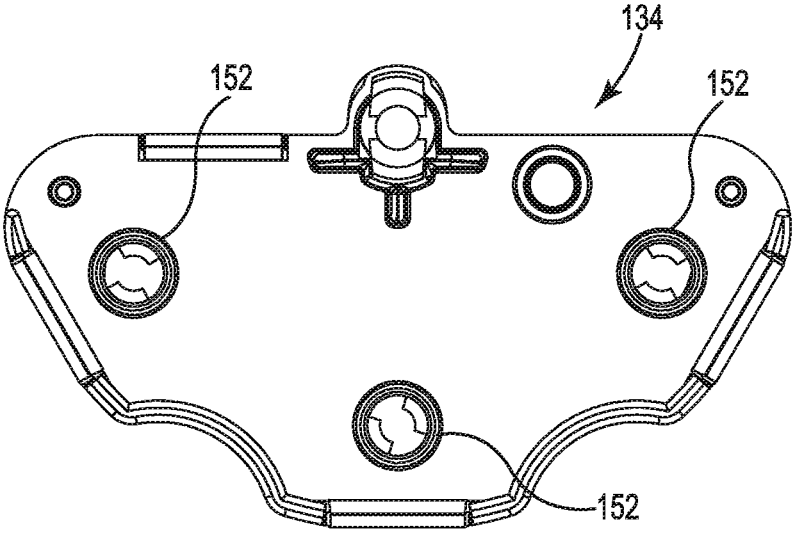
FIG. 22A is a top view of the mix manifold.

FIG. 22A is a top view of mix manifold 134. The conduits of pumping mechanisms of the individual simultaneously actuated fluid cartridges are coupled to respective inlets 152, for example using a flexible polymer ring or other fluid seal as described above.

Figure 22B:
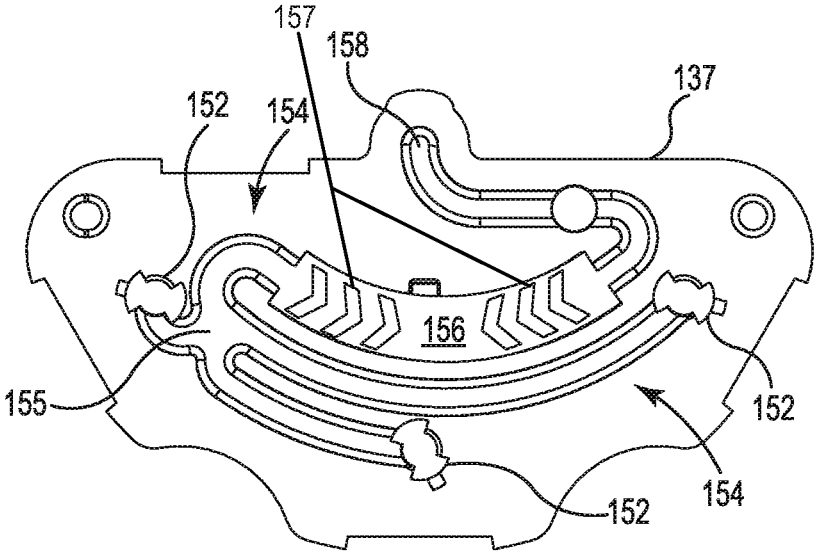
FIG. 22B is a bottom view of the top section of the mix manifold, illustrating the fluid mixing structure.

FIG. 22B is a bottom view of upper section 137 of mix manifold 134, illustrating the fluid mixing structure or flow pathway 154. As shown in FIG. 22B, different fluids from individual fluid cartridges enter upper manifold section 137 at inlets 152 to the converging flow channels. The channels causes mixing, as dispensed fluids travel to a manifold outlet, commingle at one or more nexus or intersection points 155 and continue to mix along downstream flow manifold 156 before exiting at outlet 158. One or more static mixer components 157 may also be provided, for example to promote fluid mixing along downstream manifold 156. Note that this particular configuration of static mixers 157 is merely representative, and a wide variety of suitable geometries are encompassed. Outlet 158 is coupled to bottom section 138 for flow of the mixed fluid along lower stem 136 of manifold 134, extending to mixed fluid nozzle or aperture 35M as shown in FIG. 21.

Figure 23A:
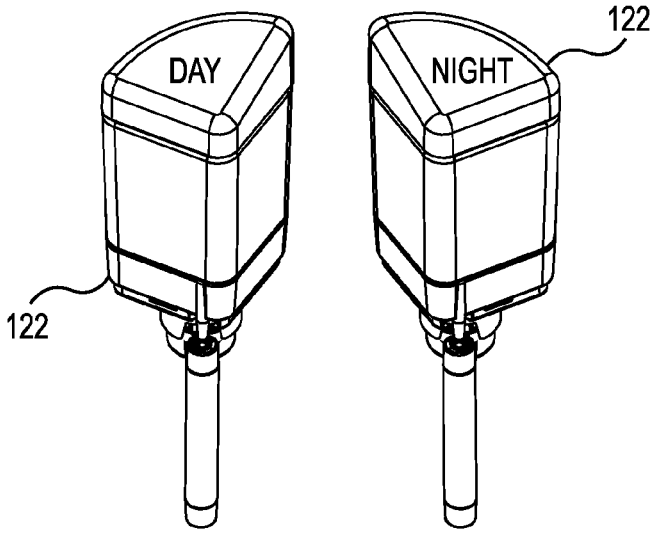
FIG. 23A is a side view of representative selectively actuated fluid cartridges for the fluid dispensing system.

FIG. 23A is a side view of representative selectively actuated fluid cartridges 122 for the fluid dispensing system. In this particular example, selectively actuated day and night cartridges are provided.

Figure 23B:
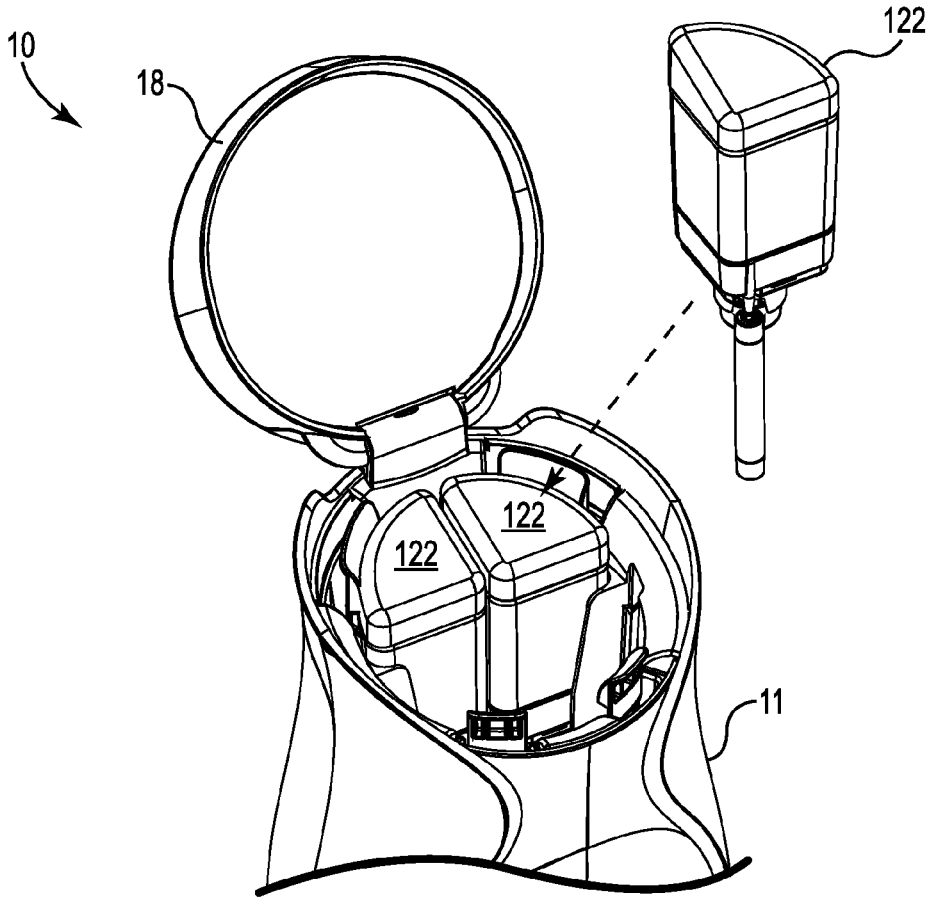
FIG. 23B is a schematic view illustrating installation of the selectively actuated fluid cartridges within the fluid dispensing system.

FIG. 23B is a schematic view illustrating installation of selectively actuated fluid cartridges 122 within fluid dispensing system 10. As shown in FIG. 23B, selected fluid reservoirs or cartridges 122 may be individually inserted, removed, or replaced, for example by opening lid 18 to gain access to the interior well portion of housing 11.

Figure 24B:
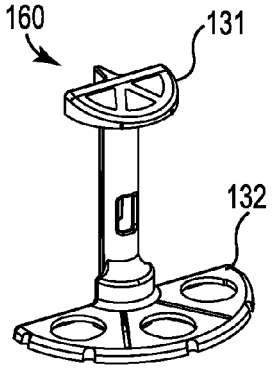
FIG. 24B is a perspective view of a cartridge frame or serum holder for the mixed actuation fluid cartridges.
Figure 24A:
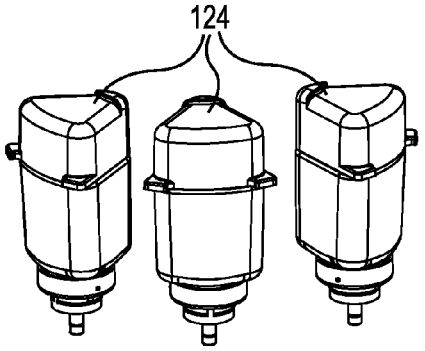
FIG. 24A is a perspective view of representative mixed actuation fluid or serum cartridges for the fluid dispensing system.

FIG. 24A is a perspective view of representative mixed actuation fluid cartridges 124 for the fluid dispensing system. In this particular example, three separate serum or treatment cartridges 124 are provided. Individual cartridges 124 may be selected based on user preference, for example to provide a directed regimen for personal, individualized skin care.

FIG. 24B is a perspective view of a serum holder or cartridge frame 160 for mixed actuation fluid cartridges 124. In this particular example, spline connector 131 and bottom connector plate 132 are provided in substantially unitary form, as a single piece frame or holder 160. Alternatively, spline section 131 and bottom plate 132 are separately formed. After insertion of selected cartridges 124, frame or holder 160 can be coupled to the mix manifold or serum connector 162 (FIG. 24C), and connected together by inserting the top portion of the serum connector or mix manifold 162 through the bottom connector and into the spline section of frame or holder 160 (see FIGS. 19 and 21). This insertion process may prevent relative rotation or lock corresponding rotational and lateral degrees of freedom in motion, but allow for linear axial motion between frame or holder 162 and mix manifold or serum connector 162 (that is, along the insertion axis of the manifold extension into the spline or frame).

Figure 24C:
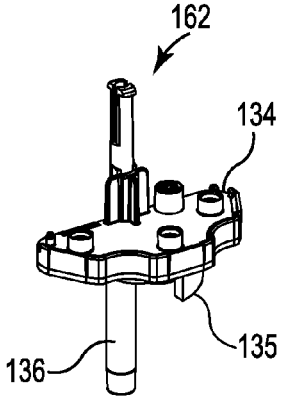
FIG. 24C is a schematic view of mix manifold or serum connector for the mixed actuation fluid cartridges.

FIG. 24C is a schematic view of mix manifold or serum connector 162 for mixed actuation (or simultaneously actuated) fluid cartridges 124. In this example, serum connector 162 is shown in substantially unitary form, for example by bonding the top and bottom portions of a mix manifold together via adhesive, mechanical connections, or using chemical or heat welding.

Figure 24D:
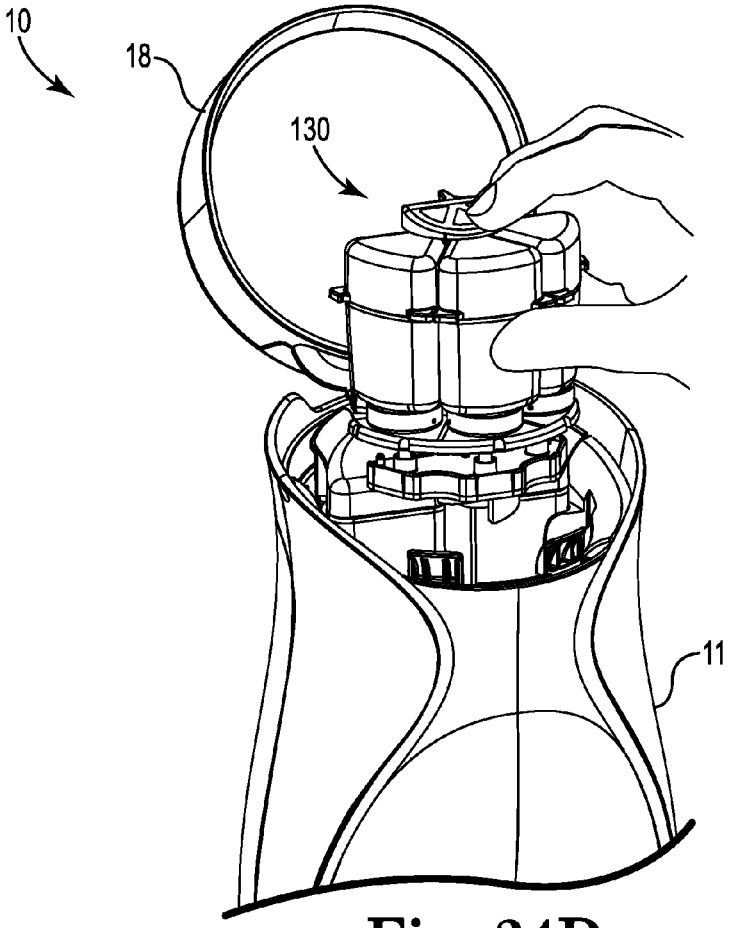
FIG. 24D is a schematic view illustrating installation of the mixed actuation fluid cartridges, cartridge frame and mix manifold within the fluid dispensing system.

FIG. 24D is a schematic view illustrating installation of mixed actuation fluid cartridges 124 into fluid dispensing system 10. As shown in FIG. 24D, a number of cartridges 124 can be inserted, removed or replaced as a unit, in the form of a cartridge assembly 130 including frame 160, serum connector 162, and two or more different fluid cartridges or fluid reservoirs 124.

Figure 25:
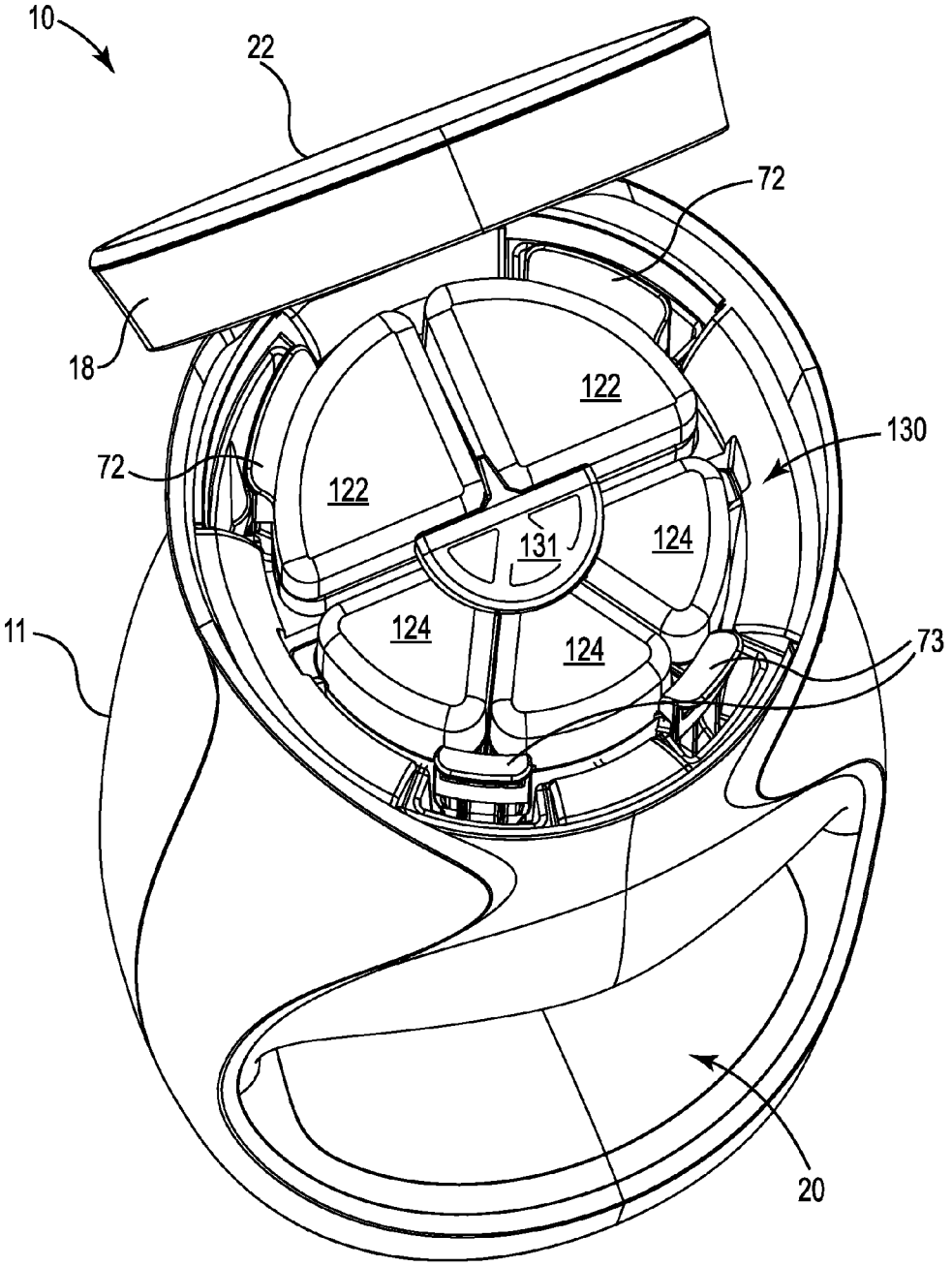
FIG. 25 is a perspective view of the fluid dispensing system, showing fluid cartridge release mechanisms.

FIG. 25 is a perspective view of fluid dispensing system 10, showing retention and release clips or mechanisms 72 and 73 for individually activated fluid cartridges 122 and simultaneously activated (mixed) fluid cartridges 124, respectively. As shown in FIG. 25, selected cartridges 122 can be individually released from or locked into the well of dispenser system 10 by manipulating the respective release mechanisms 72, for example using a manually-operated spring-loaded release and retention system as described above. Alternatively, a number of simultaneously actuated (mixed) fluid cartridges 124 can be locked into position and released as a unit, for example by manipulating one or more corresponding manually operated mechanisms 73 for cartridge assembly 130.

In one embodiment, pushing or manipulating the tabs on mechanisms 72 radially outward releases selected cartridges 122. For example, manipulating the tab on one mechanism 72 may release a first (e.g., day) cartridge 122, and manipulating the tab on a second mechanism 72 may release a second (e.g., night) cartridge 122. The other tabs on mechanisms 73 may be manipulated or pulled out radially (e.g., simultaneously), in order to release serum cartridge assembly 130 as a unit. The spring loaded plungers will lift the selected cartridges out when these tabs are flexed (see FIG. 7).

Controller and Control Method

The exemplary embodiment shown in FIGS. 12-20 (and in FIGS. 23A, 23B, 24A-24D and 25) uses five cartridges. As discussed, two of these are selectively, individually actuated fluid cartridges 122 and three of these are mixed actuation (or simultaneously actuated) fluid cartridges 124 joined by a manifold. It will be apparent that the mixed actuation (or simultaneously actuated) fluid cartridges 124 could comprise only two cartridges or could comprise four, five or more cartridges, with suitable changes to the manifold and the components holding this set of cartridges together for simultaneous pumping.

One exemplary embodiment supports a user regimen that calls for three different dispensing actions that are used at two separate times of the user's day: a day session and a night session. In particular, the embodiment supports a regimen in which the user requests and receives during a defined "day" period fluids from one dispensing action for a mixed fluid from the manifold and a second dispensing action from that one of the selectively, individually actuated fluid cartridges 122 associated with the day. During a defined "night" period, the user requests and receives again fluid from a repeated dispensing action for the mixed fluid from the manifold and from a third dispensing action from that one of the selectively, individually actuated fluid cartridges 122 associated with the night.

Focusing on the dispensing action for the mixed fluid, the action of the device is as follows. An apparatus for dispensing a flowable liquid, mixed from contents of two or more cartridges, comprises a first cartridge with a first flowable liquid and a first dispenser pump with an outlet, and a second cartridge with a first flowable liquid and a second dispenser pump with an outlet. A manifold with a fluid connection connects to the outlet of each of the first and second dispenser pumps and has a mechanical connection for actuating each of the first and second dispenser pumps and a mixing flow path that receives fluid from the outlet of each of the first and second dispenser pumps and by converging channels causes mixing, as dispensed fluids travel to a manifold outlet.

A mix manifold cam is operably engageable with the manifold to cause a pushing motion, and a mix manifold cam driver is operably connected to the mix manifold cam for moving the mix manifold cam from a home state through the pushing motion and a return to the home state. The pushing motion causes metered dispensing from each of the first and second dispenser pumps into the manifold, mixing within the converging channels and dispensing of mixed fluids from the first and second dispenser pumps at the dispenser outlet.

Focusing on the dispensing action for the individually actuated fluid cartridges 122 in coordination with the dispensing action for the mixed fluid, the action of the device is as follows. To accommodate the individually actuated fluid cartridges, a cartridge cavity is located above the dispenser opening. The cartridge cavity comprises a first volume occupied by the first cartridge and second cartridge mounted on the manifold, and a second volume occupied by a third cartridge with a third flowable liquid and a third dispenser pump with an outlet and a fourth cartridge with a fourth flowable liquid and a fourth dispenser pump with an outlet.

A time-of-day driver is selectively operably connected to either a third dispenser pump cam or a fourth dispenser pump cam for moving a selected one of the third dispenser pump or the fourth dispenser pump from a home state through a pushing motion and a return to its home state. The pushing motion causes metered dispensing from the selected one of the third dispenser pump or fourth dispenser pump at its outlet.

Where a further cartridge is added to the first and second cartridges that are part of the mixed actuation (or simultaneously actuated) fluid cartridges 124, the action of the device is as follows. A fifth cartridge with a fifth flowable liquid and a fifth dispenser pump with an outlet is combined with the first and second cartridges by using it with the mix manifold.

The manifold has a fluid connection to the outlet of the fifth dispenser pump, the mechanical connection for actuating each of the first and second dispenser pumps also actuates the fifth dispenser pump and the mixing flow path that receives fluid from the outlet of each of the first and second dispenser pumps also receives fluid from the outlet of the fifth dispenser pump, and by converging channels causes mixing of fluids from the outlets of the first, second and fifth dispenser pumps, as dispensed fluids travel to a dispenser outlet.

The manifold cam driver is operably connected to the manifold pusher cam that moves the manifold pusher cam from a rest state through the pushing motion and a return to the rest state and resulting pushing motion causes metered dispensing from each of the first, second and fifth dispenser pumps into the manifold, mixing within the converging channels and dispensing of mixed fluids from the first, second and fifth dispenser pumps at the dispenser outlet.

Figure 26A:
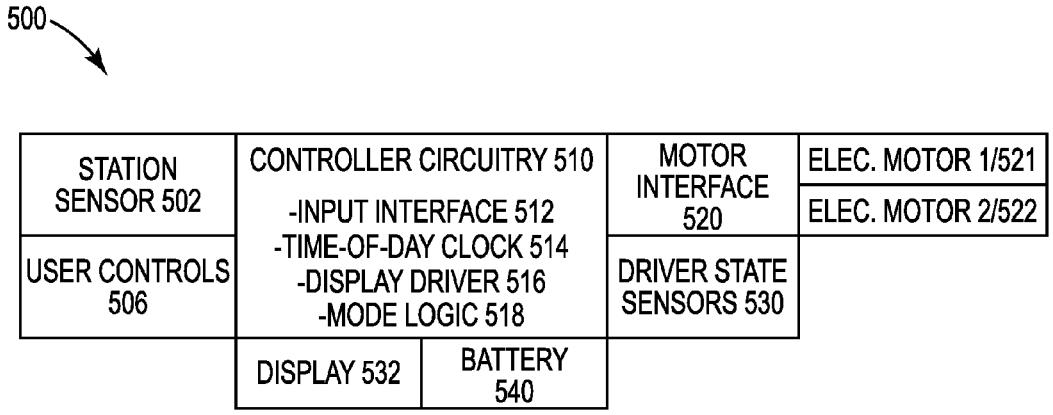
FIG. 26A is a schematic block diagram of a controller of the fluid dispensing system.

FIG. 26A is a schematic block diagram of one embodiment of a controller 500 for use in the system 10. Controller circuitry 510 may be embodied in a microprocessor with memory containing software, e.g., instructions that cause the microprocessor to perform control logic steps, or discrete logic components that are configured to perform the control logic steps. In either case the controller circuitry 510 will have a power source, such as battery 540, and have an input interface 512 for receiving input signals from user controls 506 (which may be buttons, touch pad or touch screen controls) and from a dispenser station sensor 502, which (as discussed above) senses when a user hand or user's container or other object is present at the dispenser station or opening.

Depending on the state of the control logic, that station sensor input will wake the system 10, cause one or more dispensing sequences to occur or take another action programmed into the control logic as a response to station sensor input. The controller circuitry 510 also will have a time-of-day clock 514, a display driver 516 to drive audio/visual display components 532 (see reference 65 in FIG. 6A), mode logic 518 (in software, hardware or firmware) and a motor control interface 520. The motor control interface 520 is connected to electric 'motor 1' and electric 'motor 2' and will either issue coded commands for a motor that is able to accept such commands or will control voltage, current and/or power to a motor that is controlled by these parameters. Electric 'motor 1' and electric 'motor 2' correspond to the motors 92A and 92B discussed in respect to FIG. 8.

Figure 26B:
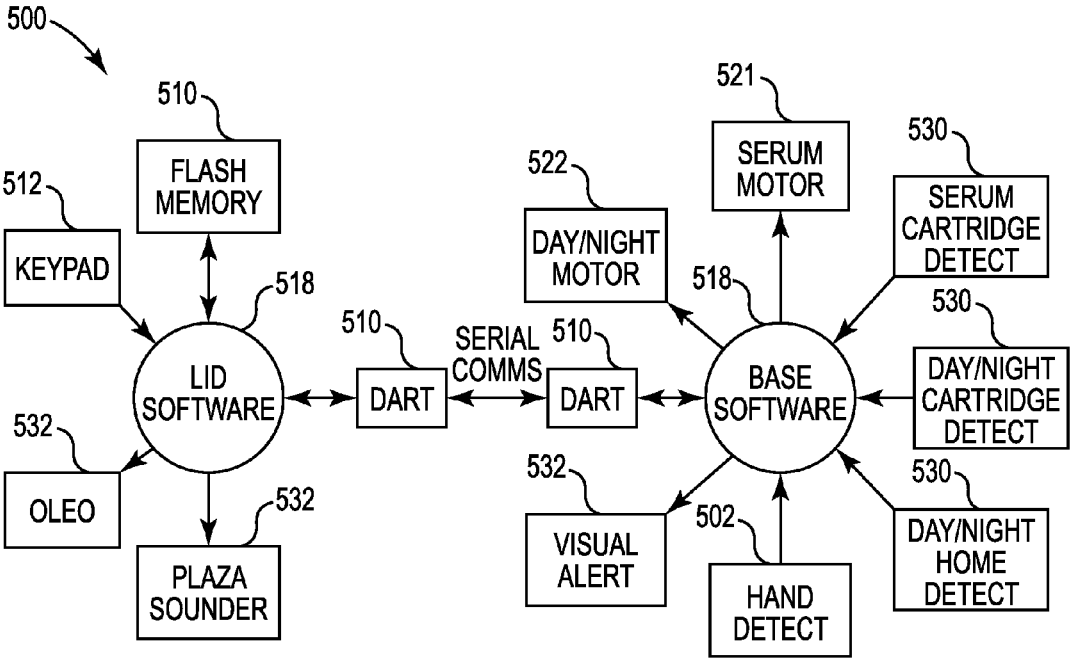
FIG. 26B is a schematic block diagram of the controller in an alternate embodiment.

FIG. 26B is a schematic block diagram of controller 500, in an alternate embodiment. In this embodiment, the lid and base components are shown in separately configured form, with universal asynchronous receiver/transmitter (UART) or other suitable communication components included in controller circuitry 510. In this embodiment, there are separate microprocessors in the lid assembly and base assembly, with different software or firmware programming stored on non-transitory computer-readable storable media accessible by each respective microprocessor. The lid software is executable by the lid assembly microprocessor to operate the user interface, and sends data and commands to the base assembly microprocessor. The base assembly microprocessor selectively operates the motors in the pump drive assembly, processes the sensors data and relays related sensor information to the lid microprocessor to determine the status of the dispenser and cartridge installation, as described herein.

In one particular example, there are also (e.g., flash) memory components in each of the lid assembly and the base assembly, configured to store, access and retain the programming code and related data in non-transitory form. The memory is computer readable, and provided in data communication with the respective microprocessors. The memory can also be configured to store data related to generating the menu screens accessible by the menu buttons, and a log file of operations data including, but not limited to, remaining product in each of the cartridges, language selected by the user, and additional operational information, even when the batteries are removed.

Controller circuitry 510 will also receive via input interface 512 input signals from driver state sensors 530. These sensors may be optical sensors, current sensors, microswitches or other elements used to sense the position of or operating condition of various components that are part of the pump driver assemblies driven by electric 'motor 1' or electric 'motor 2.' In particular, in the driver assembly for the mix manifold cam, a motor current sensor may be used to determine when the cam has been driven to the state in which the manifold has completed its full travel for dispensing one measured or metered dose of the liquids from the simultaneously activated (mixed) fluid cartridges 124. In the driver assembly for the individually activated fluid cartridges 122 optical sensors or proximity sensors may be used to determine the when the left and right actuator levers 88 and 89 for each of the individually activated fluid cartridges 122 is in its rest or home position or has completed its full travel for dispensing one metered dose of a liquid from one of the individually activated fluid cartridges 122.

Figure 27:
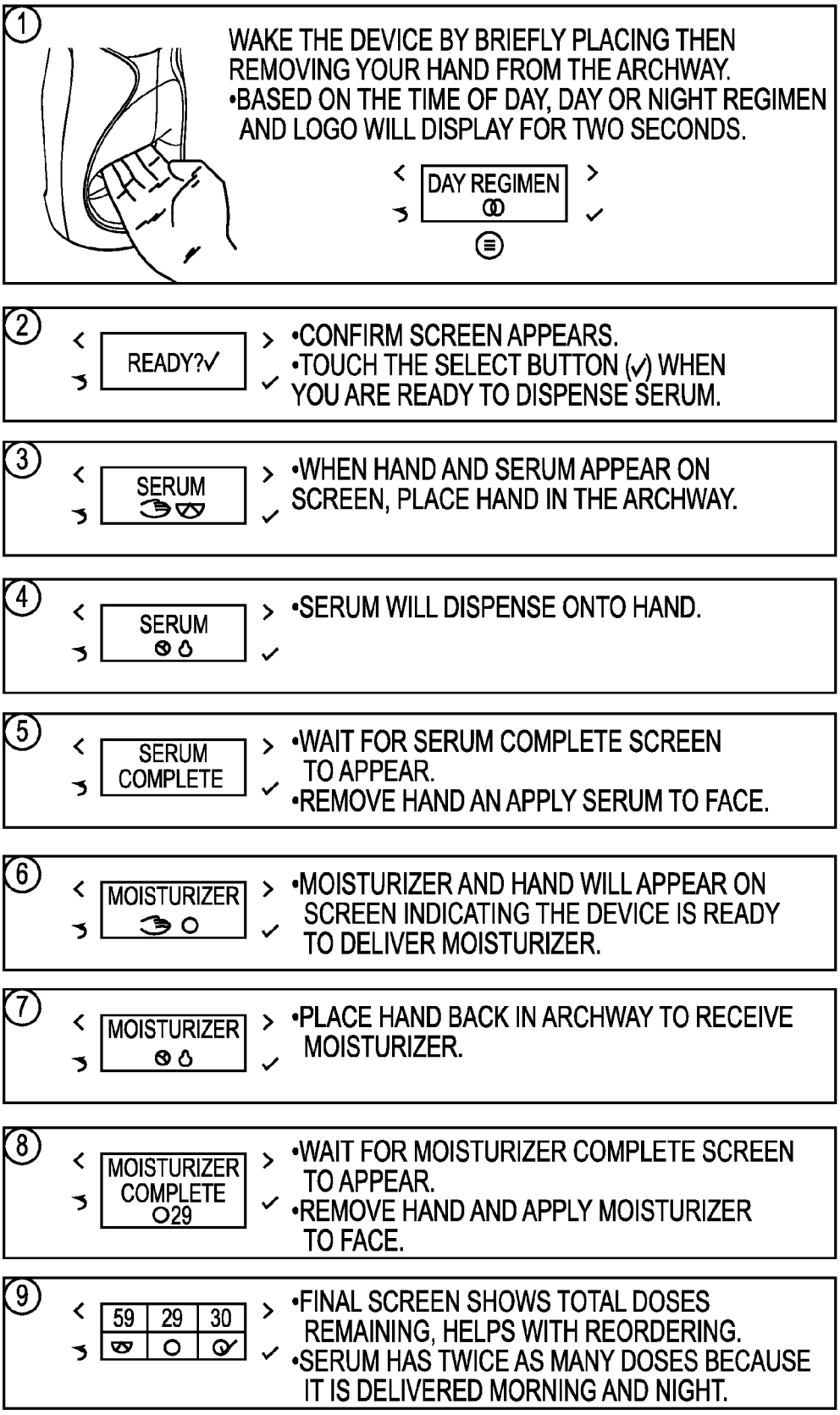
FIG. 27 shows a user instruction and flow diagram for a product delivery mode executed by a controller of the fluid dispensing system.

The control logic in controller circuitry 510 (or in software for processor execution) is used to control operational modes of the system 10. One of the operational modes, product dispensing, is shown in FIG. 27 as a sequence or steps performed with and by a user in coordination with the actions of the system 10 under control of the control logic.

In general, the product dispensing mode involves a dispenser actuator for initiating dispensing, and dispenser controller logic, including a time of day clock. The control logic responds to a user input at user controls 506 requesting fluid dispensing and a time of day from clock 514 to selectively actuate first a delivery of a metered amount of fluid from simultaneously activated (mixed) fluid cartridges 124 and then, based on predefined time of day criteria, a delivery of a metered amount of fluid from motion of one of the individually activated fluid cartridges 122.

The predefined time of day criteria partition a 24 hour day into a "day" period and a "night" period. During the day period, the control logic will cause a delivery of a metered amount of fluid by pumping motion at that one of the individually activated fluid cartridges 122 that has a "day serum" or fluid deemed appropriate for use earlier in the day. By contrast, during the night period, the control logic will cause a delivery of a metered amount of liquid by pumping motion at that one of the individually activated fluid cartridges 122 that has a "night serum" or liquid deemed appropriate for use later in the day.

In each case the control logic causes one motor and associated driver components to execute selectively the desired pumping motions using the dispenser pump cam or lever as the case may be to cause dispensing pumping from the appropriate cartridges. Further details of the features of this mode, expressed as user instructions, appear in FIG. 27.

In particular, where the user instructions call for a user action, or user input, the station sensor or user controls of the system will receive an input and the input interface will provide a signal to the controller circuitry 510. Once mode logic has been selected, it will be executed in sequence of display actions, dispensing actions and user actions that complete the dispensing steps specified in the control logic. For this mode, the control logic uses the time of day and the time of day criteria as part of the logic for determining how to start the dispensing sequence and what parts of the driver assembly to deploy to perform dispensing from the appropriate cartridge or cartridges, in the manner specified in the steps: first dispensing a mixed serum and then a day or night moisturizer.

Figure 28A:
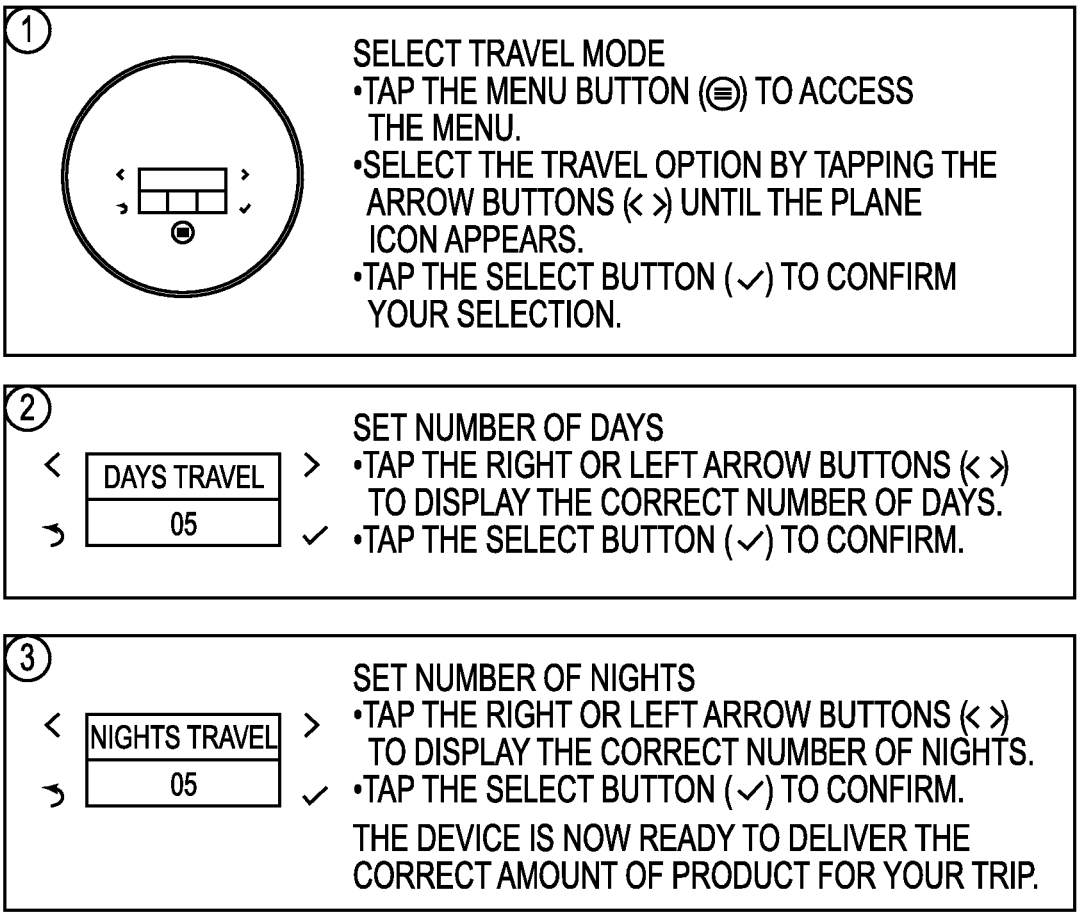
FIGS. 28A and 28B are a block flow diagram illustrating a method for advanced product delivery executable by a controller of the fluid dispensing system, for example in a travel mode.
Figure 28B:
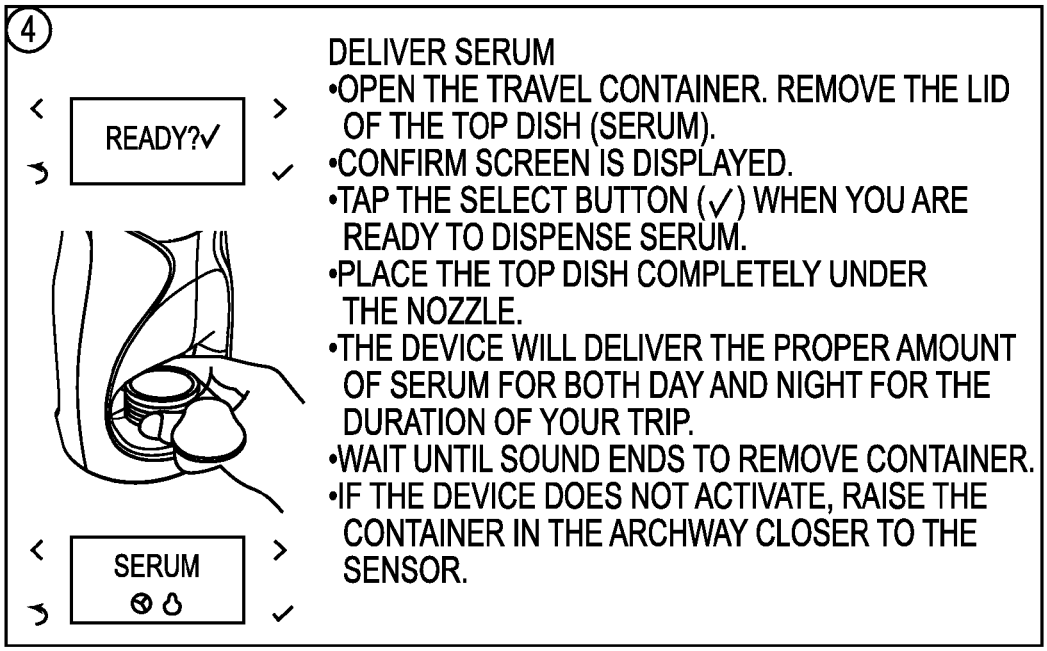
Figure 28B:
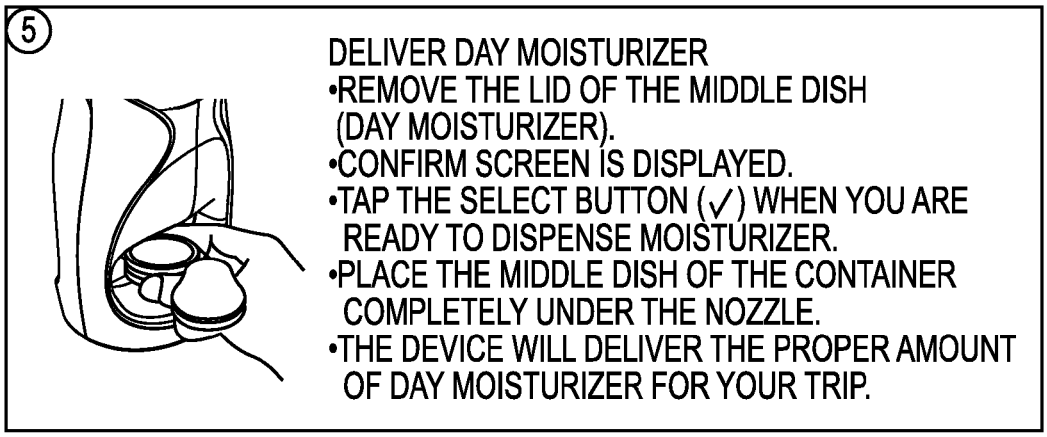
Figure 28B:
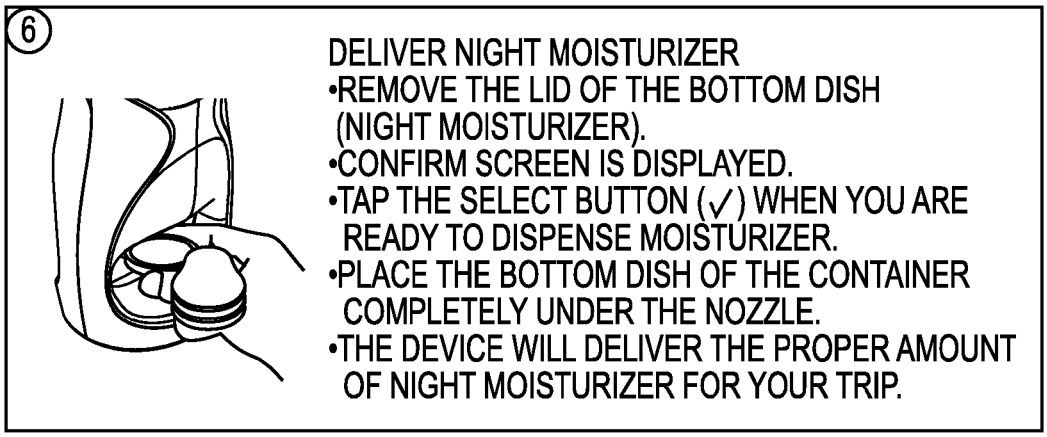

A second of the operational modes, travel dispensing, is shown in FIGS. 28A and 28B, as a sequence or steps performed with and by a user in coordination with the actions of the system 10 under control of the control logic. In general, the travel dispensing mode involves a dispenser actuator for initiating dispensing, and dispenser controller logic, including user input signals for a selected number of days and nights of travel.

The control logic responds to user input at user controls 506 requesting dispensing and a selected number of days and nights of travel to selectively actuate the product delivery cycle discussed above for each of the day and night delivery times that will occur during the time of travel. That is, for each of the selected number of "days travel," the controller logic will execute first a delivery of a metered amount of liquid from simultaneously activated (mixed) fluid cartridges 124 for receipt by a travel container and then a delivery of a metered amount of fluid from motion of one of the individually activated fluid cartridge 122 associated with a "day" fluid for receipt by a travel container.

Similarly, for each of the selected number of "nights travel," the controller logic will execute first a delivery of a metered amount of fluid from simultaneously activated (mixed) fluid cartridges 124 for receipt in a travel container and then a delivery of a metered amount of liquid from one of the individually activated fluid cartridge 122 associated with a "night" fluid for receipt in a travel container. In this way the user may sequentially dispense into a set of travel containers, in advance of the trip, the appropriate fluids for each of the day application and night application times specified by the selected number of days and nights of travel.

Further details of the features of this mode, expressed as user instructions, appear in FIGS. 28A and 28B. In particular, where the user instructions call for a user action, or user input, the station sensor or user controls of the system will receive an input and the input interface will provide a signal to the controller circuitry 510. Once mode logic has been selected, it will be executed in sequence of display actions, dispensing actions and user actions that complete the dispensing steps specified in the control logic and in the sequence specified by the user instructions.

EXAMPLES

Examples of other embodiments of the cartridge or a set of cartridges include the following. Each of these examples may be used alone, or in any combination.

A cartridge for dispensing a first flowable liquid and for use with at least one other cartridge for dispensing a second flowable liquid to provide an output liquid mixed from the first and second flowable liquids, comprising: an enclosed volume containing a first flowable liquid and having a first dispenser pump for reciprocating inward and outward travel, said first dispenser pump being actuated by inward travel of the conduit to dispense a metered amount of the first flowable liquid; an outlet of the first dispenser pump, comprising a bottom fitting adapted for insertion in one of at least two holder openings in a cartridge holder plate, a top fitting for engagement with a top connector that lies generally parallel to and spaced from the holder plate and a pump outlet conduit extending from the bottom fitting and adapted for fluid communication connection to an inlet of a manifold connectable also to the at least one other cartridge with a second flowable liquid, said pump outlet conduit being connected to the first dispenser pump for to dispense the metered amount of the first flowable liquid from an outlet of the conduit into a mixing flow path of the manifold that receives fluid from the outlet of each of the first and second dispenser pumps.

The cartridge above wherein the first flowable liquid is a cosmetic lotion selected by a user for coordination and mixing with the second flowable liquid.

The cartridge above wherein the first dispenser pump dispenses a metered amount of the first flowable liquid from an outlet of the conduit that is determined by the distance of inward travel of the conduit.

A set of at least two cartridge for dispensing flowable liquids into a manifold to provide an output liquid mix A set of at least two cartridge for dispensing flowable liquids into a manifold to provide an output liquid mixed from the first and second flowable liquids, comprising: a first cartridge with an enclosed volume containing a first flowable liquid and having a first dispenser pump; a second cartridge with an enclosed volume containing a second flowable liquid and having a second dispenser pump; a cartridge holder plate; and a mix manifold each of the first and second cartridges comprising: an outlet of its dispenser pump, comprising a bottom fitting adapted for insertion in one of at least two holder openings in the cartridge holder plate, a top fitting for engagement with a top connector that lies generally parallel to, spaced from and connected to the holder platform and a pump outlet conduit extending from the bottom fitting and adapted for fluid communication connection to an inlet of the manifold, said pump outlet conduit being connected to it respective dispenser pump for reciprocating inward and outward travel and said respective dispenser pump being actuated by inward travel of the conduit to dispense a metered amount of the respective flowable liquid from the conduit into a mixing flow path of the manifold that receives fluid from the outlet of each of the first and second dispenser pumps.

The set of at least two cartridges above, further comprising a third cartridge for dispensing a third flowable liquid dispensed in a daytime portion of a day under the control of control logic of a dispenser in which the set of at least two cartridges is mounted and a fourth source cartridge for dispensing a fourth flowable liquid dispensed in a nighttime portion of a day under the control of control logic of a dispenser in which the set of at least two cartridges is mounted.

Examples of other embodiments of the methods include the following. Each of these examples may be used alone, or in any combination.

A method for dispensing a flowable liquid, mixed from contents of two or more cartridges, comprising: providing a first cartridge with a first flowable liquid and a first dispenser pump with an outlet; providing a second cartridge with a first flowable liquid and a second dispenser pump with an outlet; providing a mix manifold with a fluid connection to the outlet of each of the first and second dispenser pumps, a mechanical connection for actuating each of the first and second dispenser pumps and a mixing flow path that receives fluid from the outlet of each of the first and second dispenser pumps and by converging channels causes mixing, as dispensed fluids travel to a manifold outlet; providing a mix manifold cam operably engageable with the manifold to cause a pushing motion; and actuating a mix manifold cam driver operably connected to the mix manifold cam for moving the manifold pusher cam from a home state through the pushing motion and a return to the home state, said pushing motion causing metered dispensing from each of the first and second dispenser pumps into the manifold, mixing within the converging channels and dispensing of mixed fluids from the first and second dispenser pumps at the manifold outlet.

The method above, further comprising dispensing a selectable further flowable liquid, comprising: providing a third cartridge with a third flowable liquid and a third dispenser pump with an outlet and a fourth cartridge with a fourth flowable liquid and a fourth dispenser pump with an outlet, and controlling a time-of-day driver selectively operably connected to either a third dispenser pump cam or a fourth dispenser pump cam for moving a selected one of the third dispenser pump or the fourth dispenser pump from a home state through a pushing motion and a return to its home state, said pushing motion causing metered dispensing from the selected one of the third dispenser pump or fourth dispenser pump at its outlet.

The method above, further comprising: providing a dispenser actuator for initiating dispensing; and executing dispenser controller logic, including a time of day clock, said controller logic responding to a user input requesting dispensing and a time of day to selectively actuate based on a predefined time of day criteria motion of one of the third dispenser pump cam or the fourth dispenser pump cam.

The method above, wherein the predefined time of day criteria specify for a time of day in the morning selection of motion of one of the third dispenser pump cam or the fourth dispenser pump and for a time of the day in the night selection of motion of the other of the third dispenser pump cam or the fourth dispenser pump.

While this invention has been described with reference to exemplary embodiments, it will be understood by those skilled in the art that various changes can be made and equivalents may be substituted, without departing from the spirit and scope of the invention. In addition, modifications may be made to adapt the teachings of the invention to particular situations and to use other materials, without departing from the essential scope thereof. The invention is thus not limited to the particular examples that are disclosed here, but encompasses all of the embodiments falling within the scope of the claims.

The invention claimed is:

1. An apparatus for dispensing a flowable liquid, mixed from contents of two or more cartridges, comprising:

a first cartridge with a first flowable liquid and a first dispenser pump with an outlet;

a second cartridge with a second flowable liquid and a second dispenser pump with an outlet;

a manifold with a flow connection to the outlet of each of the first and second dispenser pumps, a mechanical connection for actuating each of the first and second dispenser pumps and a mixing flow path comprising an upper manifold section with channels converging at an intersection point that receives the first flowable liquid and second flowable liquid from the outlet of each of the first and second dispenser pumps and mixes these liquids as they travel from the intersection point along a downstream flow manifold to a manifold outlet, said downstream flow manifold including at least one bend of approximately 180° followed by at least one static mixer;

a mix manifold cam operably engageable with the manifold to cause a pushing motion for dispenser pump action; and a mix manifold cam driver operably connected to the mix manifold cam for moving the mix manifold cam from a home state through the pushing motion and a return to the home state, said pushing motion causing metered dispensing from each of the first and second dispenser pumps into the manifold, mixing within the converging channels and dispensing of mixed first flowable liquid and second flowable liquid from the first and second dispenser pumps at a manifold outlet.

2. An apparatus for dispensing a flowable liquid, mixed from contents of two or more cartridges, comprising:

a first cartridge with a first flowable liquid and a first dispenser pump with an outlet;

a second cartridge with a second flowable liquid and a second dispenser pump with an outlet;

a manifold with a flow connection to the outlet of each of the first and second dispenser pumps, a mechanical connection for actuating each of the first and second dispenser pumps and a mixing flow path comprising an upper manifold section with channels converging at an intersection point that receives the first flowable liquid and second flowable liquid from the outlet of each of the first and second dispenser pumps and mixes these liquids as they travel from the intersection point along a downstream flow manifold to a manifold outlet;

a mix manifold cam operably engageable with the manifold to cause a pushing motion for dispenser pump action;

a mix manifold cam driver operably connected to the mix manifold cam for moving the mix manifold cam from a home state through the pushing motion and a return to the home state, said pushing motion causing metered dispensing from each of the first and second dispenser pumps into the manifold, mixing within the converging channels and dispensing of mixed first flowable liquid and second flowable liquid from the first and second dispenser pumps at a manifold outlet; and a dispenser actuator for initiating motion of the mix manifold cam driver from the home state through the pushing motion.

3. The apparatus of claim 2, further comprising a housing with a dispensing opening, said dispenser actuator comprising a sensor for sensing the presence of a user hand or container in the dispensing opening.

4. The apparatus of claim 2, further comprising:

a cartridge cavity located above the dispenser opening, said cartridge cavity comprising:

a first volume occupied by the first cartridge and second cartridge mounted on the manifold; and a second volume occupied by a third cartridge with a third flowable liquid and a third dispenser pump with an outlet and a fourth cartridge with a fourth flowable liquid and a fourth dispenser pump with an outlet, and a time-of-day driver selectively operably connected to either a third dispenser pump cam or a fourth dispenser pump cam for moving a selected one of the third dispenser pump or the fourth dispenser pump from a home state through a pushing motion and a return to its home state, said pushing motion causing metered dispensing from the selected one of the third dispenser pump or fourth dispenser pump at its outlet.

5. The apparatus of claim 4, further comprising:

a dispenser actuator for initiating dispensing from one of the third dispenser pump or the fourth dispenser pump; and dispenser controller logic, including a time of day clock, said controller logic responding to a user input requesting dispensing and a time of day to selectively actuate based on a predefined time of day criteria motion of one of the third dispenser pump cam or the fourth dispenser pump cam.

6. The apparatus of claim 5, wherein the predefined time of day criteria specify for a time of day in the morning selection of motion of one of the third dispenser pump cam or the fourth dispenser pump and for a time of the day in the night selection of motion of the other of the third dispenser pump cam or the fourth dispenser pump.

7. The apparatus of claim 4, further comprising a fifth cartridge with a fifth flowable liquid and a fifth dispenser pump with an outlet, wherein the manifold has a flow connection to the outlet of the fifth dispenser pump, the mechanical connection for actuating each of the first and second dispenser pumps also actuates the fifth dispenser pump and the mixing flow path that receives flowable liquid from the outlet of each of the first and second dispenser pumps also receives flowable liquid from the outlet of the fifth dispenser pump, and by the converging channels causes mixing of flowable liquids from the outlets of the first, second and fifth dispenser pumps, as dispensed flowable liquids travel to the manifold outlet; and wherein the mix manifold cam driver operably connected to the mix manifold cam that moves the mix manifold cam from a rest state through the pushing motion and a return to the rest state and resulting pushing motion causes metered dispensing from each of the first, second and fifth dispenser pumps into the manifold, mixing within the converging channels and dispensing of mixed flowable liquids from the first, second and fifth dispenser pumps at the manifold outlet.

8. The apparatus of claim 2 wherein the mixing flow path comprises at least one static mixer.

9. The apparatus of claim 2 wherein the first dispenser pump dispenses a metered amount of the first flowable liquid from an outlet of a pump outlet conduit that is determined by the distance of inward travel of the conduit.

10. A method for dispensing a flowable liquid, mixed from contents of two or more cartridges, comprising:

providing a first cartridge with a first flowable liquid and a first dispenser pump with an outlet;

providing a second cartridge with a second flowable liquid and a second dispenser pump with an outlet;

providing a mix manifold with a flow connection to the outlet of each of the first and second dispenser pumps, a mechanical connection for actuating each of the first and second dispenser pumps and a mixing flow path that receives flowable liquid from the outlet of each of the first and second dispenser pumps and by converging channels causes mixing, as dispensed first and second flowable liquids travel in an upper manifold section with channels converging at an intersection point and from the intersection point along a downstream flow manifold to a manifold outlet;

providing a mix manifold cam operably engageable with the manifold to cause a pushing motion;

actuating a mix manifold cam driver operably connected to the mix manifold cam for moving the manifold pusher cam from a home state through the pushing motion and a return to the home state, said pushing motion causing metered dispensing from each of the first and second dispenser pumps into the manifold, mixing within the converging channels and dispensing of mixed first and second flowable liquids from the first and second dispenser pumps at the manifold outlet; and dispensing a selectable further flowable liquid, comprising:

providing a third cartridge with a third flowable liquid and a third dispenser pump with an outlet and a fourth cartridge with a fourth flowable liquid and a fourth dispenser pump with an outlet, and controlling a time-of-day driver selectively operably connected to either a third dispenser pump cam or a fourth dispenser pump cam for moving a selected one of the third dispenser pump or the fourth dispenser pump from a home state through a pushing motion and a return to its home state, said pushing motion causing metered dispensing from the selected one of the third dispenser pump or fourth dispenser pump at its outlet.

11. The method of claim 10, further comprising:

providing a dispenser actuator for initiating dispensing; and executing dispenser controller logic, including a time of day clock, said controller logic responding to a user input requesting dispensing and a time of day to selectively actuate based on a predefined time of day criteria motion of one of the third dispenser pump cam or the fourth dispenser pump cam.

12. The method of claim 11, wherein the predefined time of day criteria specify for a time of day in the morning selection of motion of one of the third dispenser pump cam or the fourth dispenser pump and for a time of the day in the night selection of motion of the other of the third dispenser pump cam or the fourth dispenser pump.

13. The apparatus of claim 2 wherein the mixing flow path comprises static mixers located in the downstream flow manifold.

14. The method of claim 10 wherein the mixing comprises mixing using static mixers.

15. The method of claim 10 wherein the mixing within the converging channels, comprises mixing using static mixers located in the downstream flow manifold.

16. The apparatus of claim 1, wherein said downstream flow manifold further includes at least one bend of greater than approximately 150° in a direction opposite the bend of approximately 180°.

* * * * *